US011074792B2

(12) United States Patent
Jacobs

(10) Patent No.: US 11,074,792 B2
(45) Date of Patent: Jul. 27, 2021

(54) MENTAL HEALTH, SAFETY, AND WELLNESS SUPPORT SYSTEM

(71) Applicant: Michael Jahangir Jacobs, Palo Alto, CA (US)

(72) Inventor: Michael Jahangir Jacobs, Palo Alto, CA (US)

( * ) Notice: Subject to any disclaimer, the term of this patent is extended or adjusted under 35 U.S.C. 154(b) by 0 days.

(21) Appl. No.: 16/193,840

(22) Filed: Nov. 16, 2018

(65) Prior Publication Data

US 2019/0088097 A1 Mar. 21, 2019

Related U.S. Application Data

(63) Continuation-in-part of application No. 15/341,952, filed on Nov. 2, 2016, now abandoned, which is a (Continued)

(51) Int. Cl.
*G08B 23/00* (2006.01)
*G08B 13/196* (2006.01)
(Continued)

(52) U.S. Cl.
CPC ... *G08B 13/19695* (2013.01); *G08B 13/1966* (2013.01); *G08B 13/19691* (2013.01); *G08B 25/12* (2013.01); *G08B 27/00* (2013.01)

(58) Field of Classification Search
None
See application file for complete search history.

(56) References Cited

U.S. PATENT DOCUMENTS 5,900,806 A 5/1999 Issa et al.
6,970,183 B1 11/2005 Monroe
(Continued)

OTHER PUBLICATIONS

International Search Report and Written Opinion dated Feb. 20, 2015 for International patent application PCT/US2014/065041 filed Nov. 11, 2014, 7 pages.
(Continued)

*Primary Examiner* — Julie B Lieu

(57) ABSTRACT

A plurality of mobile communications devices (121) are distributed within a defined environment (120), which may be a hospital, correctional facility, school, public building, or private building. The locations of the mobile communications devices (121) within the defined environment (120) are precisely determined using a network of beacons (122) having known fixed locations within the defined environment (120). The mobile communications devices (121) communicate with the fixed beacons (122) using any suitable wireless protocol, such as the Bluetooth protocol. In preferred embodiments, each beacon (122) knows its precise location within the defined environment (120) by assigning x and y coordinates to the beacon (122) on a site map of the defined embodiment (120). In preferred embodiments, each mobile communications device (121) comprises a processor configured to monitor inputs relating to mental health, safety, and/or wellness from a plurality of reporting devices (123) that are also situated within the defined environment (120). At least one of these inputs can comprise a floor plan or map of the defined environment (120), whereby the mobile communications device (121) is enabled to send the floor plan or map to at least one receiver (124) situated outside the confines of the defined environment (120). First responders have access to said receiver (124).

20 Claims, 11 Drawing Sheets

Related U.S. Application Data continuation-in-part of application No. 14/243,740, filed on Apr. 2, 2014, now abandoned.

(60) Provisional application No. 61/962,647, filed on Nov. 12, 2013, provisional application No. 62/719,807, filed on Aug. 20, 2018.

(51) Int. Cl.
*G08B 25/12* (2006.01)
*G08B 27/00* (2006.01)

(56) References Cited

U.S. PATENT DOCUMENTS 7,746,223 B2 6/2010 Howarter et al.
9,336,663 B1 5/2016 Cohen et al.
9,460,596 B1 * 10/2016 Moses ..... H04N 7/14
9,769,420 B1 * 9/2017 Moses ..... H04N 7/147
2001/0010493 A1 * 8/2001 Script ..... G08B 13/08 340/546
2002/0150147 A1 10/2002 Liang
2003/0132859 A1 7/2003 Bissett
2004/0036596 A1 * 2/2004 Heffner ..... G08B 13/19658 340/531
2005/0219052 A1 10/2005 Chaco
2005/0261004 A1 * 11/2005 Dietrich ..... G01S 5/02 455/456.2
2010/0020174 A1 1/2010 Maruyama et al.
2011/0195686 A1 8/2011 Darling
2012/0025979 A1 2/2012 Monnerie et al.
2012/0257615 A1 10/2012 Eskildsen et al.
2014/0132393 A1 5/2014 Evans
2014/0139681 A1 5/2014 Jones, Jr. et al.
2014/0285341 A1 9/2014 Gitau
2014/0340298 A1 11/2014 Aldossary et al.
2015/0029826 A1 1/2015 Antognini
2015/0065082 A1 3/2015 Sehgal
2015/0137972 A1 * 5/2015 Nepo ..... G08B 25/016 340/539.13
2015/0365790 A1 * 12/2015 Edge ..... H04W 4/90 455/404.2
2016/0035196 A1 * 2/2016 Chan ..... G08B 25/008 340/541
2016/0232774 A1 8/2016 Noland et al.
2017/0124836 A1 * 5/2017 Chung ..... H04W 4/90
2017/0359698 A1 * 12/2017 Wirola ..... G01S 5/0252
2017/0359796 A1 * 12/2017 Wirola ..... H04W 64/006
2019/0088097 A1 * 3/2019 Jacobs ..... G08B 13/19695

OTHER PUBLICATIONS

The American Heritage Dictionary of the English Language, site most recently visited Nov. 26, 2018 and originally visited on Apr. 28, 2016, https://www.ahdictionary.com/word/search.html?q=dedicated.

* cited by examiner

MENTAL HEALTH, SAFETY, AND WELLNESS SUPPORT SYSTEM

CROSS-REFERENCES TO RELATED PATENT APPLICATIONS

This patent application is a continuation in part (CIP) of commonly owned U.S. patent application Ser. No. 15/341,952 filed Nov. 2, 2016, entitled "Emergency Notification and Response System", which is a CIP of commonly owned U.S. patent application Ser. No. 14/243,740 filed Apr. 2, 2014, entitled "Security Condition Notification System", which claims the priority benefit of commonly-owned U.S. provisional patent application 61/962,647 filed Nov. 12, 2013, entitled "Safeschoolz notifier system"; the instant CIP also claims the priority benefit of commonly owned U.S. provisional patent application 62/719,807 filed Aug. 20, 2018, entitled "Computerized 24/7 mental health, safety and wellness support system"; the contents of said four prior patent applications are hereby incorporated by reference in their entireties into the present patent application.

TECHNICAL FIELD

The present invention pertains to systems for supporting and enhancing mental health, safety, and wellness within a defined environment 120.

BACKGROUND ART

In recent years, security protocols have been established to protect persons in public buildings, such as for example students and teachers in public schools. In certain potentially dangerous situations, security personnel may order a so-called "lockdown" or "emergency lockdown", during which students and teachers are supposed to immediately lock doors and windows in the respective location to increase their safety, e.g., in case of an active shooter or terrorism situation.

Although the specific process to be followed during a lockdown depends on the guidelines as set out by the respective school district, it typically is problematic for security personnel to assess and control the situation.

Accordingly, improved systems and methods are needed to facilitate response and assistance in emergency situations and in particular during a lockdown.

SUMMARY

The following summary of the present invention is provided to facilitate an understanding of some of the innovative features unique to the present invention and is not intended to be a full description. A full appreciation of the various aspects of the invention can be gained by taking the entire specification, claims, drawings, and abstract as a whole.

According to one aspect of the present invention, a security condition notification system is provided, comprising at least a condition transmitter device and a condition indicator device.

In one non-limiting example, the condition transmitter device comprises at least a user interface, which may be configured to allow a user to activate or enable one of at least a first and a second security condition. The condition transmitter device further comprises a transmitter communication interface, connected with said user interface and configured for transmitting a security notification signal corresponding to the activated security condition to said condition indicator device. An exemplary condition indicator device is configured for receiving said security notification signal and comprises at least an indicator module, configured to display the security condition of said condition transmitter, activated by the user.

In another aspect, a method of security condition notification with at least a condition transmitter device and a condition indicator device is provided. The method according to one non-limiting example comprises transmitting a security notification signal by the condition transmitter device upon activation of one of at least a first and a second security condition by a user, wherein the security notification signal corresponds to the security condition activated by the user. The method further comprises receiving the security notification signal by said condition indicator device and displaying the security condition of said condition transmitter by the condition indicator device.

The basic idea of one or more embodiments of the present invention is to provide a system and corresponding methods, which enable at least a visible line of communication for the respective security condition of a specific location and which may be advantageous in particular in emergency situations, such as terrorism. For example and in the case of a "lockdown" in a school, the system and methods provide a line of communication among students and teachers, inside a room or building, with security personnel outside the respective room or building.

The invention is based on the present inventor's recognition that a faster and more effective response by security guards, law enforcement or other authorities, collectively "security personnel" hereinafter, is possible by improving the communication of the condition of a room or building in an emergency situation. Certainly, the system and method may also be used during "non emergency" situations, such as drills, e.g., so-called "code red drills".

In the following explanation of the present invention according to the embodiments described, the terms "connected to" or "connected with" are used to indicate a data connection and/or transmission link between at least two components, devices, elements, interfaces, units or modules. Such connection may be direct or indirect, i.e. over intermediate components, devices, elements, interfaces, units and/or modules, and may be wired or wireless.

For example, a connection may be provided over a local area network (LAN), a wide area network (WAN), cellular network, Bluetooth network, Zigbee network and/or Wi-Fi Network using a corresponding communications protocol, such as the Internet Protocol.

It is noted that the terms "location", "room", "premises" or "space" are used interchangeably in the present specification to denote a specific space of a building. In conjunction with school security and safety, the above terms may, e.g., relate to a classroom, office, auditorium, conference room, gym, cafeteria, hallway, multi-purpose room, restroom or other any room of a school or other building.

In the context of the present invention, the term "security condition" relates to any security or safety condition or status applicable to a location where the inventive system is used. For example, one of the security conditions may correspond to a "Red Alert Status", representing a dangerous or unsafe situation. In another example, one of the security conditions may correspond to a "Green Alert Status", representing a safe situation.

In another example and in the context of security and safety of a school, business campus, church, or any other private or public building, the first security condition may relate to a "Red Alert Status", indicating that there is a problem within the respective location, requiring assistance, such as, e.g., an injured student. In a further example in the context of security and safety of a school, business campus, church, or any other private or public building, the second security condition may relate to a "Green Alert Status", indicating that the respective location is safe and that the presence of all students is checked, i.e., that all students are accounted for.

According to an aspect of the invention, the security condition notification system comprises at least a condition transmitter device and a condition indicator device. Both the condition transmitter device and the condition indicator device may be of any suitable type to communicate the aforesaid security conditions between two distinct locations, such as from the inside of a room or building to the outside of the respective room or building. Accordingly, the condition transmitter device and the condition indicator device may in one embodiment be configured to be arranged spaced from each other.

The condition transmitter device comprises at least a user interface and a transmitter communication interface, connected with said user interface.

The user interface may be of any suitable type to allow a user to activate one of at least said first and second security condition. The user interface may thus for example comprise one or more corresponding buttons, switches, such as key or rocker switches, a touch screen display, keypad or keyboard or other suitable actuators enabling a user to select at least said first or said second security condition. The user interface in one additional or alternative embodiment may comprise one or more indicators, such as LED lights or a display, to allow the user to verify the selected security condition.

The transmitter communication interface may be of any suitable type to receive information on the selected security condition from the connected user interface and to provide the security notification signal to the condition indicator device. The security notification signal corresponds to the security condition, selected by the user. Since the present security condition notification system may be used for emergency notification only, a user may not select a security condition during "non-emergency" times. The condition transmitter may in one embodiment thus be configured to provide a security notification signal corresponding to a "no condition set" or "condition clear" state in case none of the security conditions is activated by the user. Alternatively, the transmitter communication interface may be configured to not provide a security notification signal in this case.

As discussed in the preceding, the condition indicator device is configured for receiving said security notification signal from the condition transmitter device, and comprises at least an indicator module. The indicator module is configured to at least display the security condition, as set by the user with the user interface of the condition transmitter device. The indicator module may thus comprise for example one or more indicator lights, a display, such as an LED, LCD or dot-matrix display or any other suitable device for visualization of the security condition set.

The condition indicator device may be of any type to receive said security notification signal from the condition transmitter device. For example, the condition indicator device may according to one embodiment comprise an indicator communication interface for receiving at least the security notification signal. The indicator communication interface may be of any suitable type to receive the security notification signal of the condition transmitter device. The indicator module may in another embodiment be connected with said indicator communication interface.

As mentioned above, the indicator communication interface is adapted to receive the security notification signal from the condition transmitter device and more precisely from the transmitter communication interface. Accordingly, both communication interfaces in one embodiment may be adapted to communicate at least with each other. In another embodiment, the condition indicator device is configured to receive security notification signals of a plurality of condition transmitter devices, for example in case of a "centralized" system topology with a central condition indicator device. Normally, there is at least one condition indicator device per building in a multi-building campus. In some embodiments, there is one condition indicator device outside each room in a given building.

In one exemplary embodiment, the communication interfaces are configured for sending and receiving the security notification signal over a wired connection, such as using one or more cable connections between the two communication interfaces. For example, the security notification signal may be provided as a voltage signal over one or more cable connections. Alternatively or additionally to the above, the communication interfaces in one embodiment is configured for sending and receiving the security notification signal over a wireless connection. Reference is made to the networks and protocols discussed in the preceding.

While it should be apparent to one skilled in the art that the transmitter communication interface is at least configured to send the security notification signal and the indicator communication interface is at least configured to receive said security notification signal, resulting in a "one-way" communication link, one or both of the communication interfaces may be adapted in one embodiment for both transmitting and receiving information, i.e., for "two-way" communication, as discussed in more detail in the following.

In the context of the present invention, the term "security notification signal" relates to any analog or digital signal, allowing communication of at least the activated security condition. The security notification signal may certainly comprise further information, such as for example information corresponding to a device or serial number, a room or building number, time and/or date of the activation of the security notification, a still image or video of the respective room or building where the condition transmitter device is installed, additional information entered by the user using, e.g., the user interface or any other information that, depending on the type of emergency, may be helpful for security personnel to improve their response.

The security condition notification system may comprise more than the mentioned condition transmitter device and condition indicator device, as discussed in more detail in the following. Furthermore, embodiments of the present security condition notification system comprise multiple condition transmitter devices and/or condition indicator devices. Such an embodiment could be advantageous in particular in the mentioned context of security and safety of a school, business campus, church, or any other private or public building, since here, typically the multiple rooms may require a plurality of condition transmitter and indicator devices for a further improved communication of the security condition of each of the rooms.

Both the condition transmitter device and the condition indicator device may in one embodiment comprise or be integrated with further components, devices, elements, interfaces, units and/or modules. For example, the condition indicator device and/or the condition transmitter device may comprise a computing device, having at least a processor with memory/storage comprising suitable programming/software to provide the functionality discussed in the preceding and also in the following description. The software can include a kernel, operating system and/or a shell or interface. One or more application programs or modules may be "loaded", i.e. transferred from storage into memory for execution by the processor.

In one embodiment, the user interface of the condition transmitter is configured to enable a user to activate one of a first and a second security condition. In other embodiments, there is a third security condition. The user interface may comprise two corresponding rocker or key switches, allowing a user to set one of the security conditions accordingly.

The present invention according to one embodiment advantageously allows communication of an optional third security condition. For example and in the context of school security and safety as mentioned in the preceding, the third security condition may relate to a "Blue Alert Status", indicating that the respective location is safe but that not all students are accounted for, e.g., that one of the students is currently missing from his class.

According to a further embodiment, the indicator module comprises two or three indicator lights, associated with said two or three security conditions, respectively. The indicator lights may be of any suitable type, such as incandescent, halogen or LED indicator lights. The embodiment provides a particularly cost efficient setup of the condition indicator module.

In one embodiment, the first indicator light is of red color to show the "Red Alert Status", the second indicator light is of green color to show the "Green Alert Status" and the third optional indicator light is of blue color to show the "Blue Alert Status". The use of colored indicator lights advantageously allows security personnel to quickly assert the security condition of the respective room or building, even at a certain distance from the condition indicator device.

In another exemplary embodiment, the condition transmitter device and/or the condition indicator device comprises a wall-mountable housing. The present embodiment provides that the devices are easily accessible, which may be advantageous in particular in an emergency situation.

The housing may be of any suitable material, including plastic and metal materials. The housing in a further embodiment may be configured to be tamper resistant, to safely accommodate the components of the respective device and keep the system operational at all times. According to an alternative or additional embodiment, the housing may be rain- or water-resistant, which may be useful depending on the installation location. In the latter case, the user interface and/or the indicator lights may comprise elastomeric seals to improve the rain- or water-resistance.

In the above-mentioned example of the condition indicator device having a wall-mountable housing, the housing in a further embodiment accommodates at least said indicator communication interface and/or said indicator module. In the alternative or as an additional example of the condition transmitter device comprising a housing, said housing accommodates at least said user interface and said transmitter interface.

The housing may in both examples comprise further components, devices, elements, interfaces, units and/or modules. For example, the housing of the condition transmitter device may be configured to display a list of security lockdown procedures, so that in an emergency the procedures are close at hand. The housing therefore may, e.g., be provided with a retainer or bracket for attachment of a printed list or comprise a display unit, showing the lockdown procedures on a screen.

In another embodiment, the condition indicator device further comprises an acoustic notification module, configured to provide an acoustic notification at least when said first security condition is activated. As mentioned in the preceding, the first security condition may correspond to a "Red Alert Status". The present embodiment accordingly allows a further improved notification and thus a quick response of security personnel in a dangerous situation. In the aforesaid context of school security and safety the present invention according to the present embodiment allows an improved notification that there is a problem within the respective location, such as an injured student, and that assistance is urgently required. Depending on the respective application, the acoustic notification module may additionally or alternatively be configured to provide an acoustic notification when said second and/or said third security condition is activated.

The acoustic notification module may be of any suitable type and may comprise a speaker, horn, bell, piezo horn, buzzer or any other suitable device for providing an audible notification when said first security condition is activated. The acoustic notification module in one embodiment is connected with the indicator communication interface.

In a further embodiment, the security condition notification system additionally comprises an image acquisition device for obtaining imaging information. In the present context, the term "imaging information" may refer to photos or videos. In one embodiment, the image acquisition device provides a video stream or signal, e.g., with a corresponding integrated video camera. The image acquisition device may in one embodiment be integrated with said condition transmitter device. Alternatively, the image acquisition device may be provided separately from the condition transmitter device.

The image acquisition device may provide security personnel an "eye" into a classroom, hallway, or entrance area of the building in the event of an emergency, i.e., providing imaging information of the vicinity of the image acquisition device or the condition transmitter device, respectively. The image acquisition device may be configured to transmit said imaging information over a wired or wireless connection. The image acquisition device may be installed at the entrance of a campus.

The image acquisition device in one embodiment is configured to provide said imaging information to a computing device or a mobile computing device at the site of installation of the security condition notification system, such as in an office. Alternatively or additionally, the image acquisition device may be configured to provide said imaging information to the Internet, so that security personnel can access said information remotely. In a further alternative or additional embodiment, the image acquisition device may be connected with a DVR (digital video recorder).

According to another exemplary embodiment, the image acquisition device is connected at least with said condition transmitter device and is set to be operable when any of the security conditions is activated. In other embodiments, the image acquisition device is operable continuously.

The image acquisition device may be connected with said condition transmitter device over a wireless or wired connection as mentioned in the preceding. For example, the image acquisition device may comprise a further communication interface, adapted for communication with the transmitter communication interface for receiving said security notification signal. Alternatively, the image acquisition device may be connected with a camera trigger output of the condition transmitter device or of the transmitter communication interface, which is operated when a user activates said first security condition. The security notification system may comprise more than one image acquisition device, e.g., for a better coverage of the respective room, building, hallway, or entrance area that is monitored. The image acquisition device in another embodiment comprises a recognition module connected with a database containing information pertaining to attributes of persons of interest. The recognition module may be configured to match recognized faces, weapons, body armor, etc. with said database information and trigger one of said security notification signals if a match is found. The matching can use artificial intelligence software. For example, the database may comprise face information of known terrorists or child molesters. If a match is found, the system automatically informs security personnel that a threat exists in the respective building or campus due to the presence of a terrorist or child molester. Results of the matching process can be memorialized in a written report. In general, the database contains any information that can be considered to pertain to attributes of persons of interest, as such information can be useful to security personnel in diagnosing the situation and in formulating an appropriate response to the situation. As used throughout this specification including claims, "attributes of persons of interest" means photographs of known terrorists; fingerprints of nefarious individuals; empirical information provided by the FBI; multiple images of different examples of body armor and weapons; facial characteristics of individuals, taking into account what they may look like at different ages and/or with different hair color, height, weight, and/or gender; examples of explosives and devices associated with explosives; types of clothing, masks, and shoes; and anything else that can be used by artificial intelligence software in helping security personnel evaluate threats and respond to threats.

In another exemplary embodiment, the system further comprises a locking device, connected with at least said condition transmitter device and configured to lock a door or window at least when said second security condition is activated by the user.

One embodiment allows automatic locking of said door or window when the first security condition is set, which corresponds in a school environment to the "Red Alert Status." This is in particular advantageous during a "lockdown" event, since here, the teachers are typically required to lock the door of the room they are in. Accordingly, the present embodiment facilitates a lockdown. In other embodiments, the door locking system integrates with the overall system in different ways. Much of the approach will be dictated by the local police department that each school or campus is connected with. In one embodiment, all doors on campus operate separately from the condition status reporting process. All doors can lock at the same time once a threat has been reported or detected. In another embodiment, the door locks are operable with just the green or blue condition status, as the red status would only serve to lock out law enforcement from the room at a time when they absolutely need to get in. In another embodiment, the door locks are activated with all three color conditions. Also, any of the door locks can be installed in a normally closed or normally open circuit status.

In a further embodiment, said door or window is optionally locked in case of a "Blue Alert Status", i.e., when said optional third security condition is activated.

The locking device may be of any suitable type to safely lock the respective door or window. For example, the locking device may comprise a mechanical actuator, which e.g., operates a locking bolt to lock said door or window. Alternatively or additionally, the locking device may be configured for electromagnetic locking using a corresponding magnet. The security condition notification system may comprise more than one locking device, for example in case more than one door or window requires locking.

The locking device may be connected with said condition transmitter device over a wireless or wired connection. Reference is made to the networks and protocols discussed in the preceding.

For example, the locking device may comprise a communication interface, adapted for communication with the transmitter communication interface for receiving said security notification signal. Alternatively, the locking device may be connected with a locking trigger output of the condition transmitter device or of the transmitter communication interface, which is operated when a user activates said second or third security condition.

In a further embodiment, the locking device is formed integrally with said condition transmitter device.

According to another exemplary embodiment, the system additionally comprises a remote activation unit, adapted to enable a user at least to activate said first security condition and configured for transmitting a remote notification signal to said condition transmitter device and/or said condition indicator device. The remote notification signal corresponds to the security condition, as activated by the user using the remote activation unit.

The remote activation unit allows the user to activate the first security condition, corresponding in one example to the "Red Alert Status", even if the user is not in the direct vicinity of the condition transmitter device. This decreases the time to activate the respective security condition and may be particularly useful when the system is used in a large room, such as a cafeteria or gym.

The remote activation unit may in one example be adapted to provide said remote notification signal to the condition indicator device, either directly or using an intermediate component or device.

The remote activation unit may comprise a remote communication interface, adapted for communication with the transmitter communication interface or the indicator communication interface, depending on the setup of the security notification system. For example, the remote communication interface may be configured to send said remote notification signal to the transmitter communication interface of the condition transmitter device, which then may serve as a "relay" and provide the corresponding security notification signal to the condition indicator device and, if present, to any further device of the system.

It is noted that the remote notification signal and the security notification signal may be of the same or different type. In the latter case, the transmitter communication interface may be configured to convert the remote notification signal to the type of the security notification signal so that the condition indicator device may properly display the activated security condition.

In one embodiment, the remote activation unit may additionally or alternatively be configured to allow the user to activate the second and/or the optional third security condition.

According to another embodiment, the remote activation unit is a portable device. The present embodiment allows for example a teacher to keep the device at hand at all times during class. The portable device in one embodiment may be a key fob, i.e., a device adapted to be carried on a keychain. In particular in case of a portable device, the remote activation unit comprises at least one indicator light to allow the user to verify that the respective security condition has been properly activated. Alternatively or additionally, the remote activation unit in another example may be configured to allow the user to deactivate the previously set security condition, by activating a different security condition. However, if the previously set security condtion was Red Alert, the security condition won't be changed, to foil perpetrators who could try to deactivate the security condition in an attempt to elude authorities.

In a further exemplary embodiment, the remote activation unit is a wall-mountable device. The remote activation unit according to the present embodiment may, e.g., correspond to a "pull station", i.e., having a lever to activate said first security condition. In another embodiment, the remote activation unit comprises a key lock to deactivate the security condition previously set.

According to a further embodiment, the system additionally comprises a backup battery device, connected at least to said condition transmitter device and to said condition indicator device, to provide said devices with operating power. The present embodiment provides a backup power supply and thus keeps the system operational at all times, even in case of a power mains failure.

The backup battery device may be of any suitable type. In one embodiment of a 24V battery, the backup battery device has a rating of 7 A to 100 A. In case of a 12V backup battery, the backup battery device has a rating of 7 A to 40 A.

Certainly, the backup battery device may be configured to power multiple condition transmitter devices and/or condition indicator or further devices, if present in the system. With a battery rating in the above given exemplary ranges, the backup battery device may be configured to operate three sets of condition transmitter, condition indicator and locking devices, e.g., for three rooms.

In another embodiment, the condition transmitter device comprises an intercom unit, allowing an audio communication at least when one of said security conditions is activated by the user. The present embodiment further improves the communication in an emergency.

The intercom unit may be of any suitable type. For example and in the above-mentioned context of school security and safety, the intercom unit may provide a two-way audio communication between teachers and students in a classroom and security personnel. In particular in the case of the aforementioned image acquisition device, the communication may additionally comprise picture or video information.

In some embodiments, the intercom unit is activated only when any security condition is activated. The user interface may also, in other embodiments, be configured to allow operation of said intercom unit without activation of a security condition.

The intercom unit in one alternative or additional embodiment may be configured to contact security personnel over a wired or wireless connection. Reference is made to the networks and protocols discussed in the preceding. For example, the intercom unit may be configured to connect to a corresponding intercom unit or computing device of security personnel, e.g., over the Internet. In another alternative or additional embodiment, the intercom unit may be provided with a POTS phone connection module or a cellular module for a wireless communication over the cellular network, such as a GSM network, also referred to as "GSM dialer". The GSM dialer in one example is configured to dial a predefined number of the nearest police department when one of said security conditions is activated. In a further alternative or additional embodiment, the condition indicator device comprises a second intercom unit, configured for communication with said intercom unit of said condition transmitter device. The system can have a plurality of options as to who is to receive the outgoing message. For example, one dialer can dial out to a non-police emergency number for medical emergencies. If a student has a life threatening allergic reaction, a police response is not necessary. In this case, the school would not go into a lockdown, but first responders would still be able to assist the student quickly.

According to a further embodiment, the transmitter communication interface is additionally configured to transmit a second security notification signal to a further device. For example, the transmitter communication interface may be configured to transmit the second security notification signal to security personnel or to the nearest police department over a wired or wireless connection, as mentioned in the preceding. In another example, the transmitter communication interface may be configured to provide information referring to the activated security condition to security personnel by e-mail or text message (SMS) using an Internet connection and/or the above mentioned phone connection module or said cellular module. Additionally or alternatively, the transmitter communication interface in one example comprises a digital input and output enabling a connection to further/external devices, such as motion sensors, switches, alarm relays or door locks.

The second security notification signal and the first security notification signal may be of the same or different type, depending on the setup of the system.

The present invention according to this embodiment may be particularly advantageous in an exemplary and non-limiting embodiment, where besides the aforementioned condition transmitter device and condition indicator device, a central condition indicator device is provided. A central condition indicator may, e.g., comprise a stationary or mobile computing device with a central indicator communication interface to receive said second security notification signal, and a processing unit, having a respective programming to display the received security condition on a connected display device.

In a further additional embodiment and in case the central condition indicator is configured to receive security notification signals from a plurality of condition transmitter devices, the second security notification signal may comprise identification information, allowing correlation of the received security notification signal to a specific condition transmitter device of said plurality and thus to a predefined location, e.g., within the building.

The mentioned central condition indicator device in one example is provided to display the received security condition on a connected display device, installed in an office. In another example, the central condition indicator device comprises multiple display devices. The provision of multiple display devices allows one to install a display device at every entrance of the respective building or campus to indicate if a security condition is set and thus if the respective building or campus is safe or unsafe. The multiple display devices may, e.g., be LED indicator poles.

An additional aspect of the present invention relates to a condition transmitter device having at least a user interface, configured to enable a user to activate one of at least a first and a second security condition and a transmitter communication interface, connected with said user interface and configured for transmitting a security notification signal corresponding to the activated security condition to a condition indicator device.

The condition transmitter device according to the present invention provides improved communication in an emergency situation. The condition transmitter device may further be adapted according to one or more embodiments discussed in the preceding or following with reference to the other aspects of the present invention.

Another aspect of the present invention relates to a condition indicator device having at least an indicator module. The condition indicator device is configured to receive a security notification signal from a condition transmitter device, which security notification signal corresponds to one of at least a first and a second security condition. The indicator module is configured to display the security condition of said condition transmitter device, activated by the user.

The condition indicator device may be adapted according to one or more embodiments discussed in the preceding or following. For example, the condition indicator device may comprise an indicator communication interface for receiving said security notification signal and be connected with said indicator module. Alternatively or additionally, the indicator communication interface may be configured to receive security notification signals from a plurality of condition transmitter devices. This may in particular be useful in case the condition indicator device is a "central" condition indicator device.

In a further additional or alternative embodiment, the security notification signal may comprise identification information, allowing correlation of the received security notification signal with a specific condition transmitter device of said plurality and thus with a predefined location, e.g., within the building.

Another aspect of the present invention relates to a method of security condition notification with at least a condition transmitter device and a condition indicator device. The method upon activation of one of at least a first and a second security condition by a user comprises transmitting a security notification signal by the condition transmitter, wherein the security notification signal corresponds to the security condition, activated by the user. Further, the method comprises receiving the security notification signal by said condition indicator device and displaying the security condition of said condition transmitter by the condition indicator device.

Another aspect of the present invention relates to a method of security condition notification with at least a condition indicator device. The method comprises receiving security notification signals from a plurality of condition transmitter devices, wherein the security notification signals correspond to security conditions, activated by the users of said plurality of condition transmitter devices. The method further comprises displaying the security conditions of said plurality of condition transmitter devices by said condition indicator device.

In an additional or alternative embodiment, the security notification signal may comprise identification information, allowing correlation of the received security notification signal to a specific condition transmitter device of said plurality and thus to a predefined location, e.g., within the building.

A computer program or module may be provided to enable a processor to carry out one or more of the methods discussed above. The computer program may be contained on a computer readable medium, such as a solid state, magnetic or optical storage device.

These and other aspects of the invention will be apparent from and elucidated with reference to the embodiments described hereinafter.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF PREFERRED EMBODIMENTS

Figure 1:
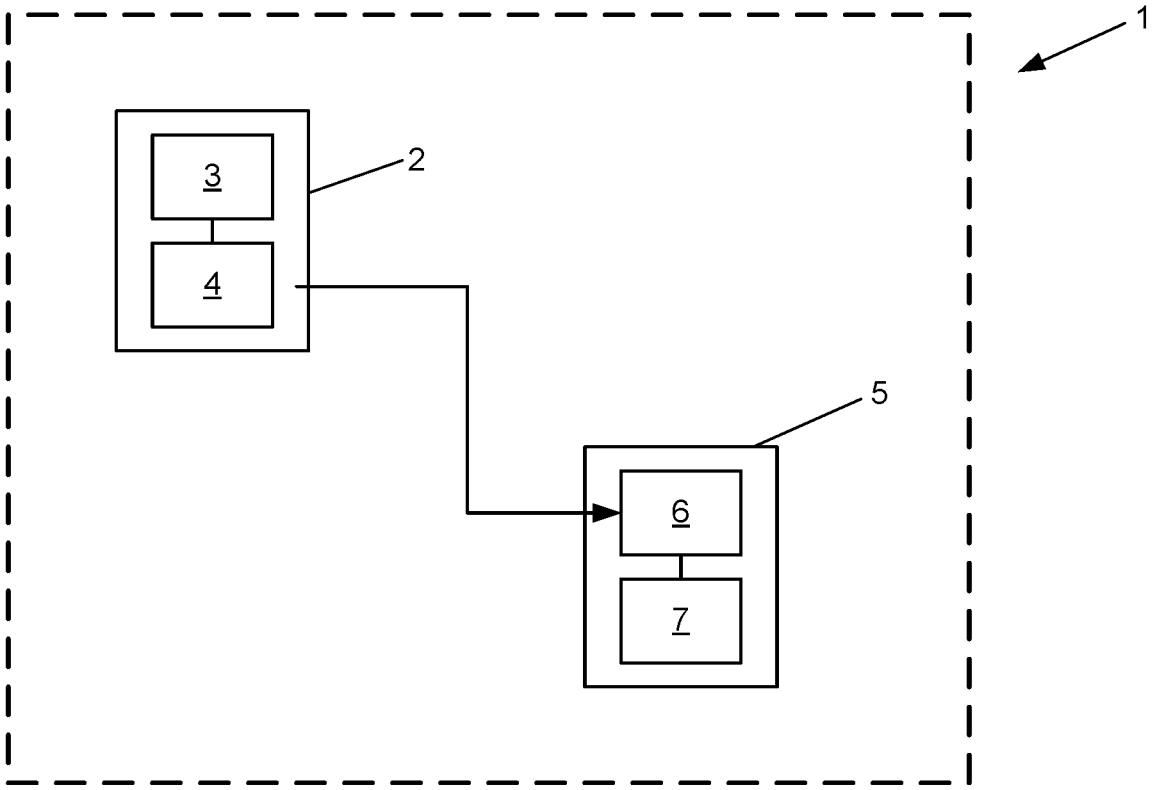
FIG. 1 is a schematic view of a first embodiment of a security notification system 1 according to the present invention.

Technical features described in this application can be used to construct various embodiments of security condition notification systems and methods to facilitate response and assistance in an emergency situation.

It has been identified that in the field of security and safety and in particular during a so-called "lockdown" event in a private or public building 40, e.g., in a school, hospital or other private, public, or government building, it may be problematic for security personnel to assess and control the situation.

In one approach, the present inventor has recognized that a faster and more effective response by security guards, law enforcement or other authorities, collectively "security personnel" hereinafter, is possible by improving the communication of the condition of a room 41 or building 40 in an emergency situation.

By providing a security condition notification system as discussed in the following, communication is improved among those inside a room 41 or building 40 and those outside a room 41 or building 40. For example during a "lockdown" in a school 40, typically requiring all interior doors 81 to be kept locked, the inventive system provides an improved communication between, e.g., teachers and students in a classroom 41 and security personnel in a hallway 44.

Reference will now be made to the drawings, in which the various elements of embodiments will be given numerical designations and in which embodiments will be discussed so as to enable one skilled in the art to make and use the invention.

Specific reference to components, process steps, and other elements are not intended to be limiting. Further, it is understood that like parts bear the same reference numerals, when referring to alternate Figures. It will be further noted that the Figures are schematic, are provided for guidance to the skilled reader, and are not necessarily drawn to scale. Rather, the various drawing scales, aspect ratios, and numbers of components shown in the Figures may be purposely distorted to make certain features or relationships easier to understand.

In the following explanation of the present invention according to the embodiments described, the terms "connected to" or "connected with" are used to indicate a data connection and/or transmission link between at least two components, devices, elements, interfaces, units or modules. Such connection may be direct or indirect, e.g., over intermediate components, devices, elements, interfaces, units and/or modules; and may be wired or wireless.

For example, a connection may be provided over a WAN, LAN, cellular network, Bluetooth network, Zigbee network and/or Wi-Fi Network, using a corresponding communications protocol, such as the Internet Protocol.

It is noted that the terms "location", "room", "premises" or "space" are used interchangeably in the present specification to denote a specific space in a building 40. In the context of school security and safety, the above terms may, e.g., relate to a classroom, office, auditorium, conference room, gym, cafeteria, hallway, multi-purpose room, restroom or other any room 41 of a school 40.

In the context of the present invention, the term "security condition" may relate to any security or safety condition or status applicable to a respective location where the inventive system 1 is used. For example, one of the security conditions may correspond to a "Red Alert Status", representing a dangerous or unsafe situation. In another example, one of the security conditions may correspond to a "Green Alert Status", representing a safe situation.

In another example and in the context of school security and safety, the first security condition may relate to a "Red Alert Status", indicating that there is a problem within the respective location requiring assistance, such as, e.g., an injured student. In a further example in the context of school security and safety, the second security condition may relate to a "Green Alert Status", indicating that the respective location is safe and that the presence of all students is checked, i.e., that all students are accounted for. A third security condition may relate to a "Blue Alert Status", indicating that the respective location is safe but that not all students are accounted for, e.g., that one of the students is currently missing from his or her class.

Referring to FIG. 1, a first embodiment of a security notification system 1 is shown in a schematic view. The security notification system 1 comprises at least a condition transmitter device 2 and a condition indicator device 5. The condition transmitter device 2 comprises a user interface 3 and a transmitter communication interface 4. In some embodiments, the condition transmitter device 2 is touch-screen activated, and must be accessed by a security card, to protect against false alarms. In some embodiments, the card is swiped through a card reader affixed to the device 2 in order to activate the device 2. In other embodiments that use the NFC protocol, the card is simply placed close to the device 2 in order to activate the device 2.

The user interface 3 allows a user to activate one of at least a first and a second security condition, such as the above mentioned "Red Alert Status" and "Green Alert Status". The user interface 3 may thus, for example, comprise one or more corresponding buttons, switches, such as key or rocker switches, a touch screen display, keypad or keyboard or other suitable actuators 21 enabling a user to select at least said first or said second security condition. The user interface 3 in one embodiment comprises one or more indicators 22, such as LED lights or a display, to allow the user to verify the selected security condition.

The transmitter communication interface 4 is connected with said user interface 3. In the FIG. 1 embodiment, the transmitter communication interface 4 is connected with said user interface 3 over a wired connection for receiving the user input.

The transmitter communication interface 4 provides a security notification signal to the condition indicator device 5. The security notification signal corresponds to the activated security condition, and thus allows the condition indicator device 5 to determine when a security condition is activated by the user, and which security condition has been activated.

An exemplary condition indicator device 5 according to one embodiment comprises an indicator communication interface 6 for receiving said security notification signal over a wired or wireless connection. The condition indicator device 5 may further comprise an indicator module 7, connected to the indicator communication interface 6 and configured to display the security condition of said condition transmitter 2, as activated by the user.

The indicator module 7 may thus comprise, for example, one or more indicator lights, a display, such as an LED, LCD or dot-matrix display or any other suitable device 22 for visualization of the security condition set.

It will be apparent from the above that the security condition notification system 1 according to the present embodiment allows communication of the security condition, set by the user, from the condition transmitter device 2 to the condition indicator device 5. Since both devices 2, 5 are provided separate from each other, improved communication of security conditions from room 41 to room 41 is advantageously enabled, even during a "lockdown", where doors 81 are to be kept locked. Opening of a door 81 or window in such case may pose substantial danger, e.g., during an active shooter or terrorism event.

Figure 2:
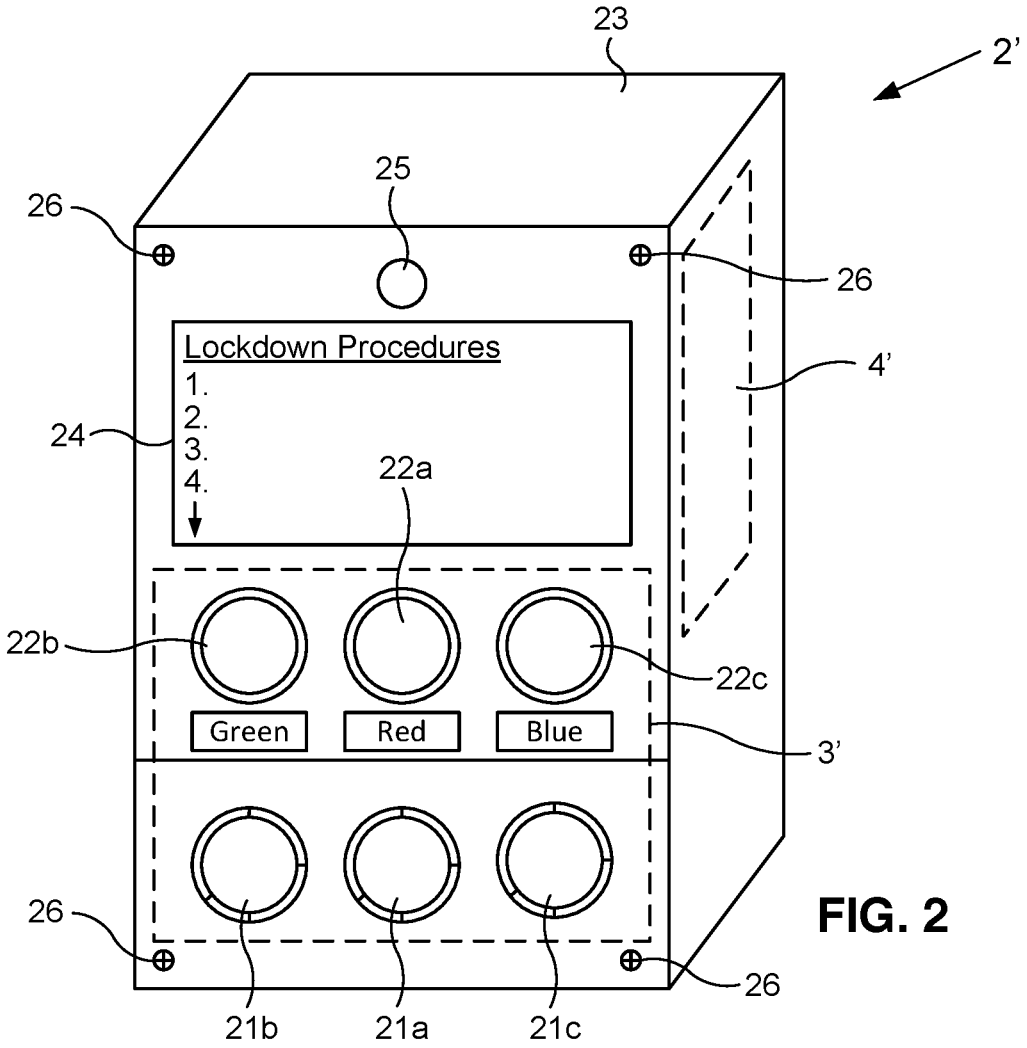
FIG. 2 is a perspective view of an embodiment of a condition transmitter device 2' for use in a security notification system.

FIG. 2 is a perspective view of an embodiment of a condition transmitter device 2' for use in a security notification system 1. The condition transmitter device 2' comprises user interface 3', which comprises three key switches 21*a*, 21*b*, 21*c* to allow a user to activate the first, second and third security condition, respectively, using a corresponding key. It is noted that in one alternative embodiment, the key switches 21 are replaced by other switches, such as rocker switches.

The user interface 3' further comprises three color coded LED indicator lights 22*a*, 22*b*, 22*c*, which light up when the corresponding first, second or third security condition is activated, and thus allow the user to verify the selection of the selected security condition. The first indicator light 22*a* is a red LED to indicate a "Red Alert Status". The second indicator light 22*b* is a green LED to show a "Green Alert Status". The third indicator light 22*c* is a blue LED to indicate a "Blue Alert Status".

The condition transmitter device 2' further comprises transmitter communication interface 4', which is provided inside transmitter housing 23, and thus is shown only by a dotted line in FIG. 2. The transmitter communication interface 4' is connected with the user interface 3' internally over a wire connection (not shown).

Figure 3:
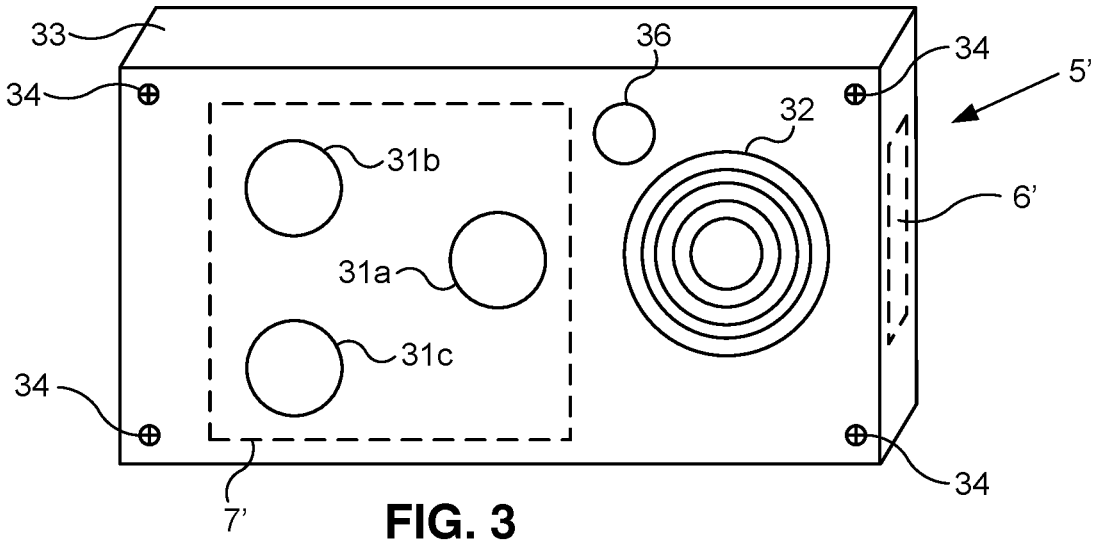
FIG. 3 is a perspective view of an embodiment of a condition indicator device 5' for use in a security notification system.

The transmitter communication interface 4' is further connected with the indicator communication interface 6' of a condition indicator device 5, an embodiment of which is shown in FIG. 3, to provide a security notification signal to the condition indicator device 5' when a user selects one of the first, second, or third security condition.

The condition transmitter device 2' further comprises a display 24 for attachment of, or other display of, lockdown procedure instructions of the current school district or other institution 40, to facilitate a quicker response to the emergency. Furthermore, the condition transmitter device 2' according to the present embodiment comprises an image acquisition device 25, such as a still or video camera. The camera 25 can be configured to connect to a Wi-Fi or other network available on site 40. Other connections, as mentioned in the preceding, are possible.

The image acquisition device 25 can be activated automatically when any security condition is activated by the user, such as by actuation of key switch 21*a*. To provide this functionality, the image acquisition device 25 is connected to a camera trigger output (not shown) of transmitter communication interface 4'.

The image acquisition device 25 is provided to give security personnel an "eye" into the respective room 41 during the event of a code "Red" emergency. The security personnel can access the images or video produced by image acquisition device 25 over the Internet, e.g., using password protection.

The transmitter housing 23 according to the present example has an outward casing, made from plastic material. The housing 23 is wall-mountable. Screws 26 of the housing 23 are of tamper-proof design.

FIG. 3 is a perspective view of an embodiment of condition indicator device 5' for use in a security notification system 1. The condition indicator device 5' according to the present embodiment comprises an indicator communication interface 6' and an indicator module 7'. Both of the aforesaid components are mounted in indicator housing 33, which, according to the present example, is a wall-mountable, weatherproof plastic or metal enclosure, having mounting screws 34 of tamper-proof type. The enclosure 33 may comprise transparent plastic or glass to shield LED indicator lights 21, 31. Enclosure 33 may be made of bullet resistant materials.

While the indicator communication interface 6' is arranged inside indicator housing 33, shown in FIG. 3 by dashed lines, indicator module 7' comprises LED indicator lights 31*a*, 31*b*, 31*c*, visible from the outside of housing 33. The LED indicator lights 31*a*, 31*b*, 31*c* are color coded, corresponding to LED indicator lights 21*a*, 21*b*, 21*c*. LED indicator lights 31*a*, 31*b*, 31*c* are installed in housing 33 with rubber seals for weatherproof protection. Indicator module 7' is connected with communication interface 6' internally over a wire connection.

The condition indicator device 5' further comprises a piezo horn 32 or other device providing a loud acoustic signal, which is activated when the first security condition, corresponding to a "Red Alert Status" is set, to alert security personnel that immediate assistance is needed. In some embodiments, condition indicator device 5' further comprises a push button 36 which, when pushed, activates the audible alarm 32. When push button 36 is present, it is protected with a security device, e.g., a locking cover, to protect against false alarms.

The operation of security notification system 1 will in the following be explained with reference to an embodiment comprising condition transmitter device 2' according to FIG. 2 and condition indicator device 5' according to FIG. 3. In this example, condition transmitter device 2' may be installed in a classroom 41 of a school 40. Condition indicator device 5' is mounted in the hallway 44, outside the classroom's door 81.

In this embodiment, said transmitter communication interface 4' is connected with said indicator communication interface 6' over three signaling cable connections (not shown). The signaling cable connections allow operation of the respective LED indicator lights 31*a*, 31*b*, 31*c* and horn 32 of the condition indicator device 5' with a corresponding operating voltage and current of said transmitter communication interface 4', when one of the three security notification signals is activated. The security notification signal thus corresponds to a 12V signal. The transmitter communication interfaces 4', 6' may in other embodiments be configured for transmission of a digital security notification signal over a wired or wireless connection.

In case an emergency situation is present, a lockdown may be ordered by the security personnel or the headmaster of the institution 40. For example, the lockdown may be announced over the school's public address system. A teacher in the classroom 41 may then, according to the instructions provided in display 24, lock the door 81 of the classroom 41 according to the lockdown instructions. (See FIG. 8.) Subsequently and after determining whether all students are present, the teacher may set the appropriate security condition using one of the key switches 21*a*, 21*b*, 21*c*. LED indicator lights 22*a*, 22*b*, 22*c* will show the selected security condition. Simultaneously, transmitter communication interface 4' will provide the above voltage signal to indicator communication interface 6'. The respectively connected LED indicator light 31*a*, 31*b*, 31*c* of the indicator module 7' will light up correspondingly, allowing security personnel to determine the security condition of this specific classroom 41 from its outside. As mentioned in the preceding, piezo horn 32 or other audible device is activated only when a "Red Alert Status" is given.

Figure 9:
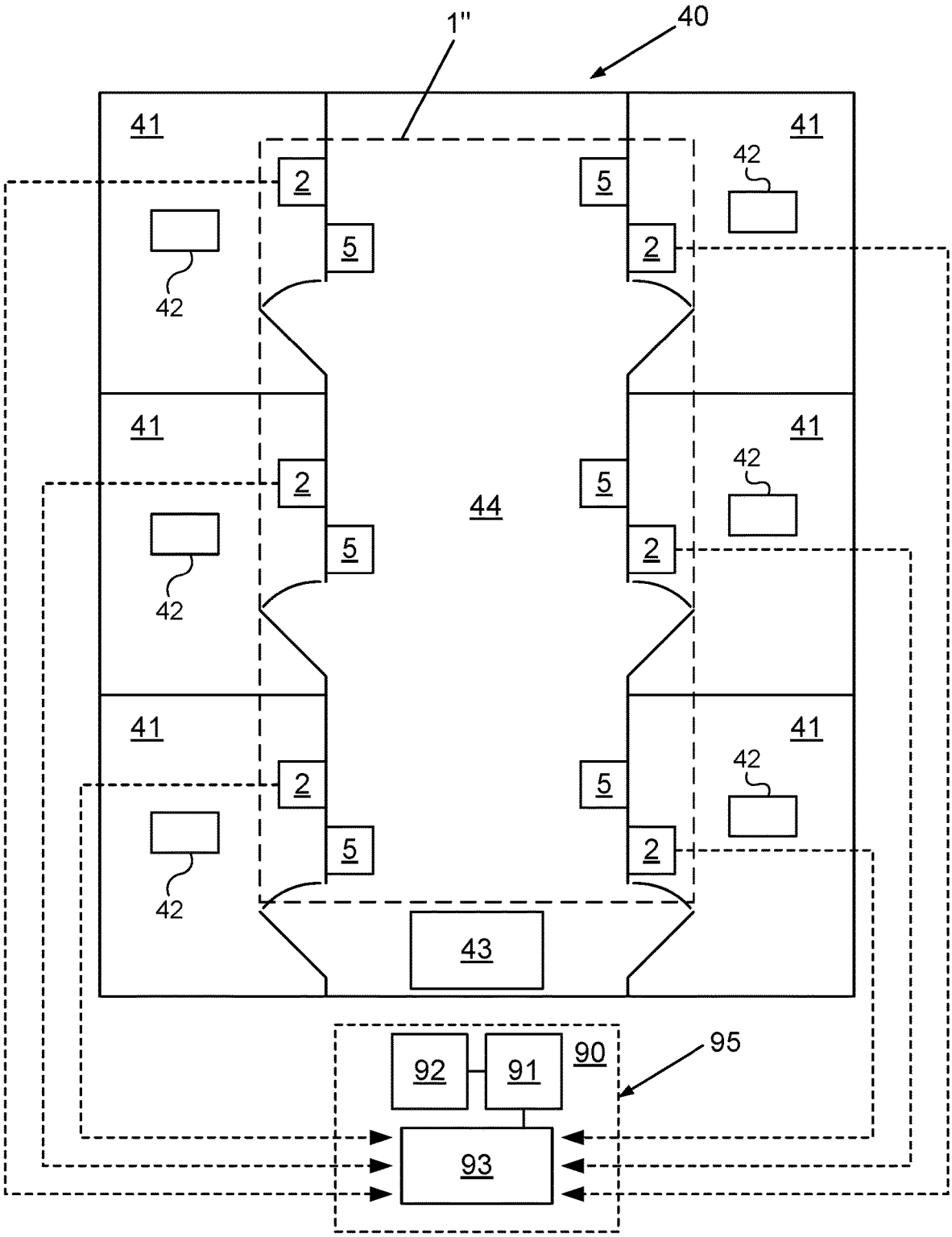
FIG. 9 is a schematic view of a further embodiment of a security notification system 1" having a plurality of condition transmitter devices 2 and condition indicator devices 5.

In an embodiment of the inventive security notification system 1, more than one pair of condition transmitter devices 2 and condition indicator devices 5 are present. In another embodiment, a plurality of condition transmitter devices 2 are connected with a central condition indicator device 90, which may be part of a local hub 95, as shown in FIG. 9.

Figure 4:
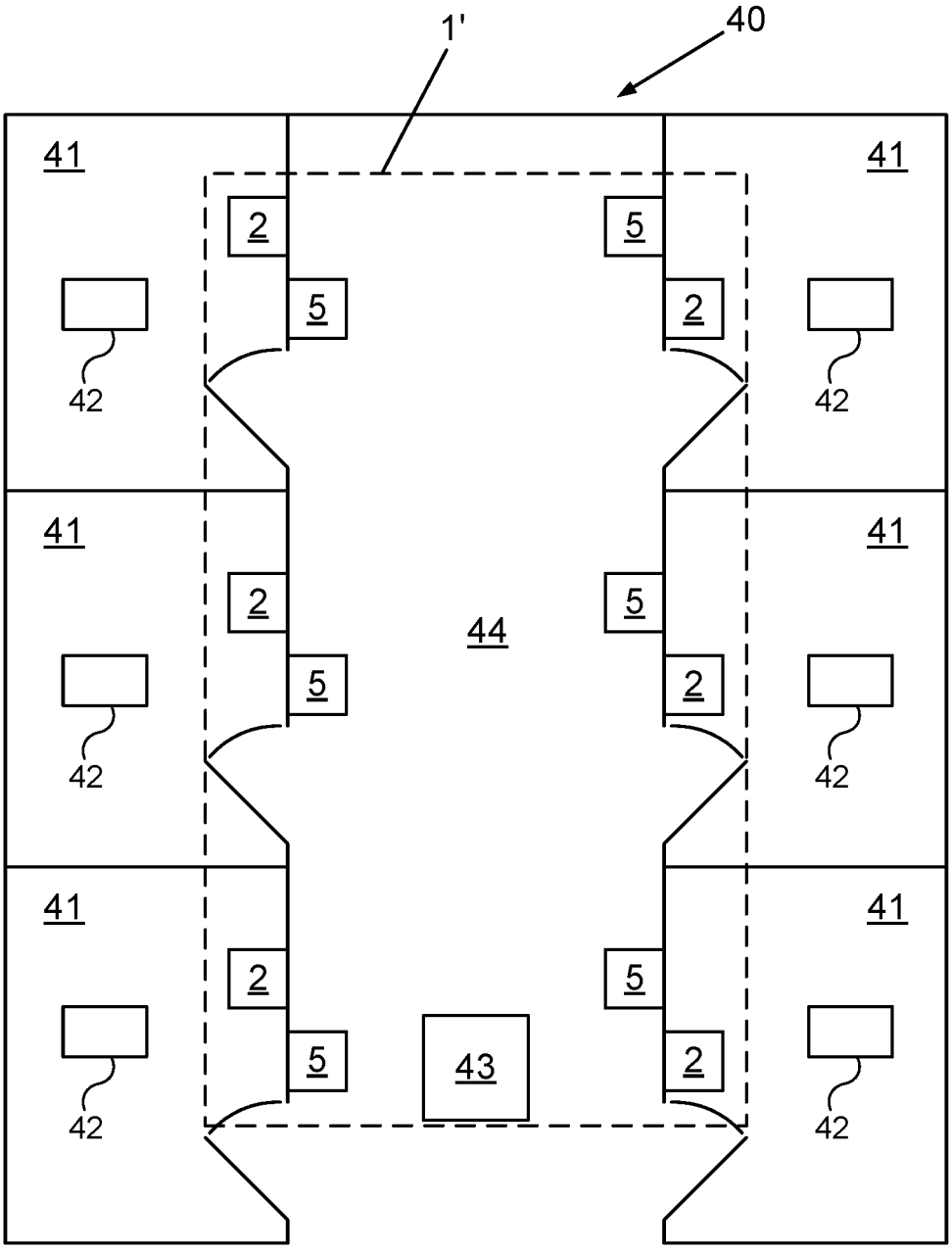
FIG. 4 is a schematic view of a second embodiment of a security notification system 1' having a plurality of condition transmitter devices 2 and condition indicator devices 5.

FIG. 4 is a schematic view of a further embodiment of a security notification system 1' having a plurality of condition transmitter devices 2 and a corresponding plurality of condition indicator 5 devices. FIG. 4 shows the system 1' installed in a school 40 having multiple classrooms 41 leading to a common hallway 44. As can be seen from FIG. 4, one condition transmitter 2 is installed in each classroom 41, while the corresponding condition indicator device 5 is installed outside the respective classroom 41 in the hallway 44. For easy access, all of the devices 2, 5 are wall-mounted. A given condition transmitter device 2 may correspond to the embodiment shown in FIG. 2 or to any other embodiment described herein. Similarly, a given condition indicator device 5 may correspond to the embodiment shown in FIG. 3 or to any other embodiment described herein.

FIG. 4 shows a surveillance camera 42 installed in each room 41. Each camera 42 may operate continuously, may be activated manually, or may be activated upon the occurrence of a preselected condition, e.g., a red alert condition sent from a condition transmitter device 2 located in that room 41. FIG. 4 also shows signage 43 located in the hallway 44. Signage 43 at that location and in other parts of the campus 40 can be activated when a button 21 is pressed on an authorized condition transmitter 2. The color and/or the text displayed on each signage 43 can be made to correspond to the particular button 21 that has been pressed.

Figure 5:
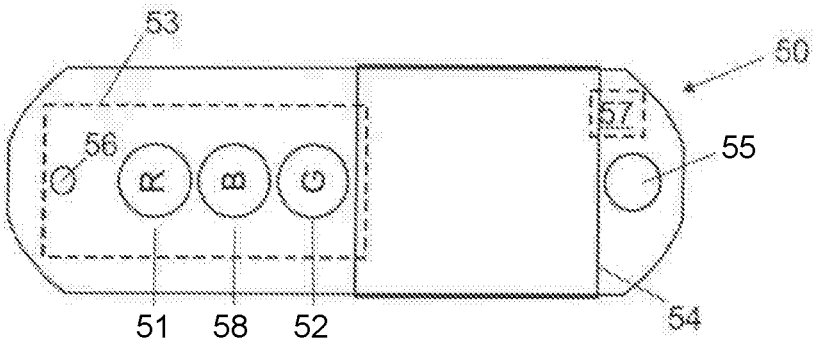
FIG. 5 is a front view of an embodiment of a remote activation unit 50 for use in a security notification system 1 of the present invention.

FIG. 5 is a front view of an embodiment of a remote activation unit 50 for use in a security notification system 1 of the present invention. According to this embodiment, remote activation unit 50 is a portable transmitter, having a hole 55 for attachment to a key ring. The remote activation unit 50 comprises a user interface 53 having three latching-type buttons 51, 52, 58 to activate the first, second, and third security conditions, respectively, and a multi-color LED indicator 56 to verify the activated security condition. Unit 50 can be carried in a pocket of a user, or worn around the neck of the user on a lanyard. A slidable protective cover 54 is provided to cover buttons 51, 52, 58, e.g., while the remote notification unit 50 is in the pocket of a user, to reduce the risk of a false alarm.

Remote activation unit 50 also comprises a wireless communication interface 57. The wireless communication interface 57 is configured to transmit a wireless remote notification signal to a condition transmitter device 2. The wireless remote notification signal can indicate which security condition has been activated. In this embodiment, transmitter communication interface 4 of a condition transmitter device 2 is adapted to receive the wireless remote notification signal. According to the present example, the wireless communication interface 57 and the transmitter communication interface 4 are configured for communication in the 433 MHz ISM radio band having three channels, so that each of the security conditions uses one channel.

The transmitter communication interface 4, upon reception of the signal, acts as a relay and provides a corresponding security notification signal to a corresponding condition indicator device 5. In case the remote activation unit 50 is used in conjunction with condition transmitter device 2' according to the embodiment shown in FIG. 2, the transmitter communication interface 4' simultaneously activates LED indicator light 22*a* of the user interface 3'.

Figure 6:
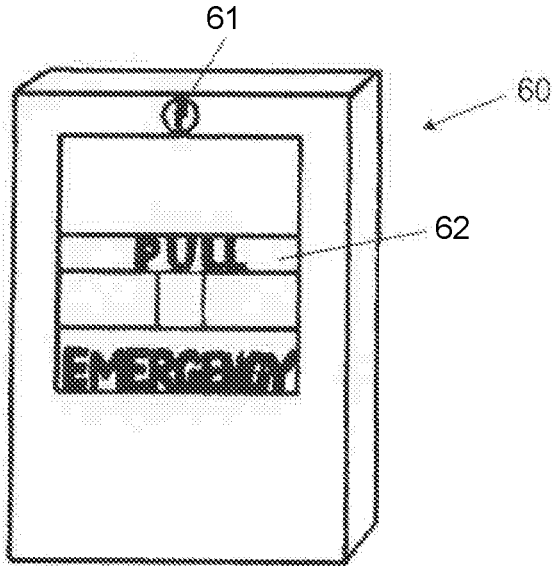
FIG. 6 is a perspective view of another embodiment of a remote activation unit 60 for use in a security notification system 1 of the present invention.

FIG. 6 is a perspective view of another embodiment of a remote activation unit 60 for use in a security notification system 1. Remote activation unit 60 is a wall-mountable "pull-station" comprising an activation lever 62. According to the present embodiment, the remote activation unit 60 allows a user to activate said first security condition ("red alert") in an emergency. Key lock 61 allows a person in authority to reset the activated security condition with a corresponding key.

Remote activation unit 60 is connectable with a transmitter communication interface 4 over a wire connection to transmit a wire remote notification signal to the corresponding condition transmitter device 2, which triggers the corresponding security notification signal being sent, as explained in the preceding. It is noted that the security notification signal, the wireless remote notification signal, and the wire remote notification signal may be of the same type or different type. In the latter case, conversion of the signals is provided by the transmitter communication interface 4.

Figure 7:
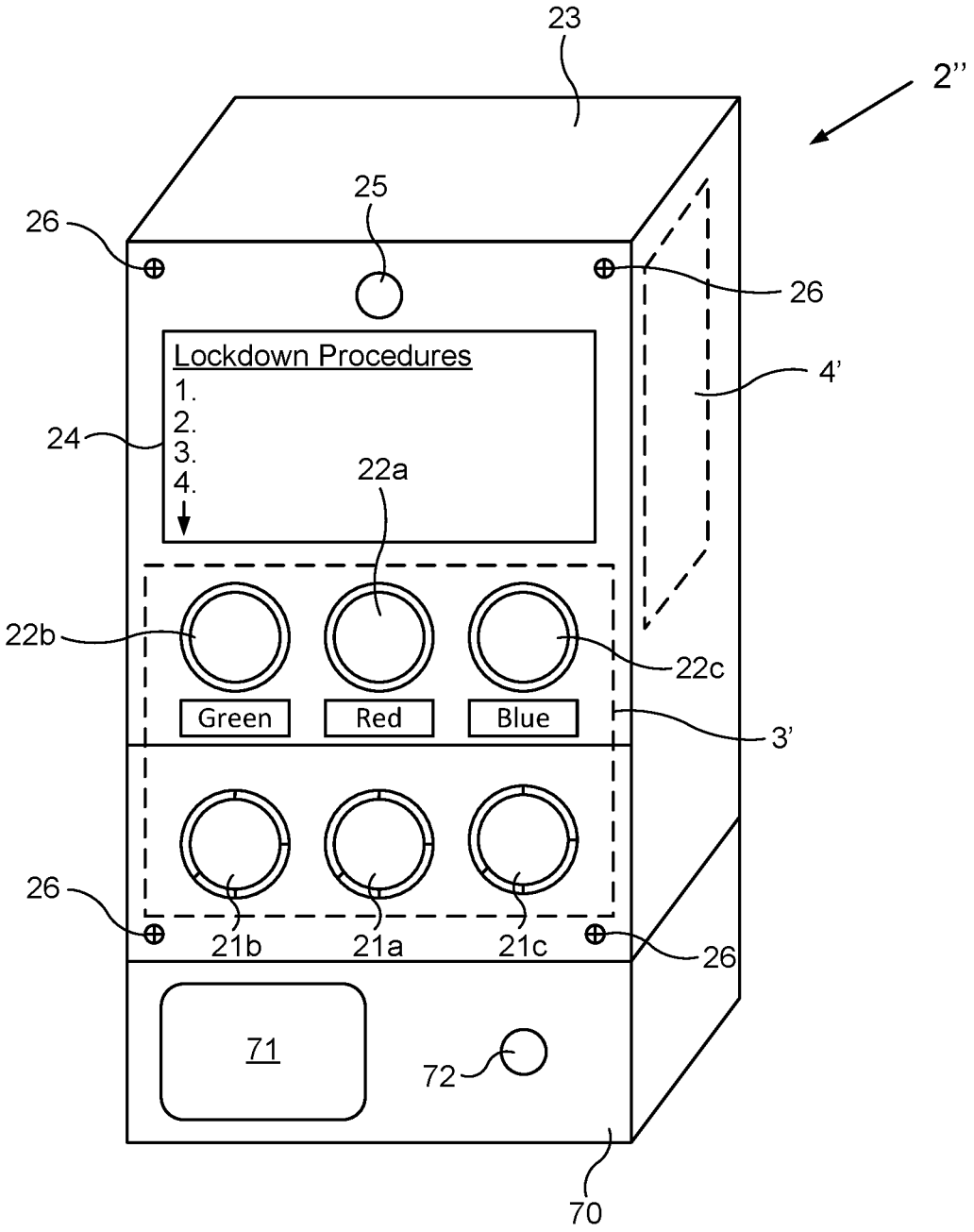
FIG. 7 is a perspective view of a further embodiment of a condition transmitter device 2" for use in a security notification system 1.

FIG. 7 is a perspective view of a further embodiment of a condition transmitter device 2" for use in a security notification system 1. The present embodiment corresponds to the embodiment shown in FIG. 2, with the exception of intercom unit 70. Intercom unit 70 comprises a speaker 71 and a microphone 72, to enable a two-way audio communication among, in the context of a school 40, teachers and students inside a room 41 with security personnel located outside the room 41. Intercom unit 70 can be activated automatically when said first ("red alert") security condition is activated, e.g., using user interface 3', button 51, or lever 62. To provide this functionality, the intercom unit 70 is connected with transmitter communication interface 4' over an internal trigger output of interface 4' (not shown).

Intercom unit 70 may comprise a cellular module (not shown) to contact outside security personnel over a cellular network, such as a GSM network. In one example, the cellular module is configured to contact the nearest police department 95.

Figure 8:
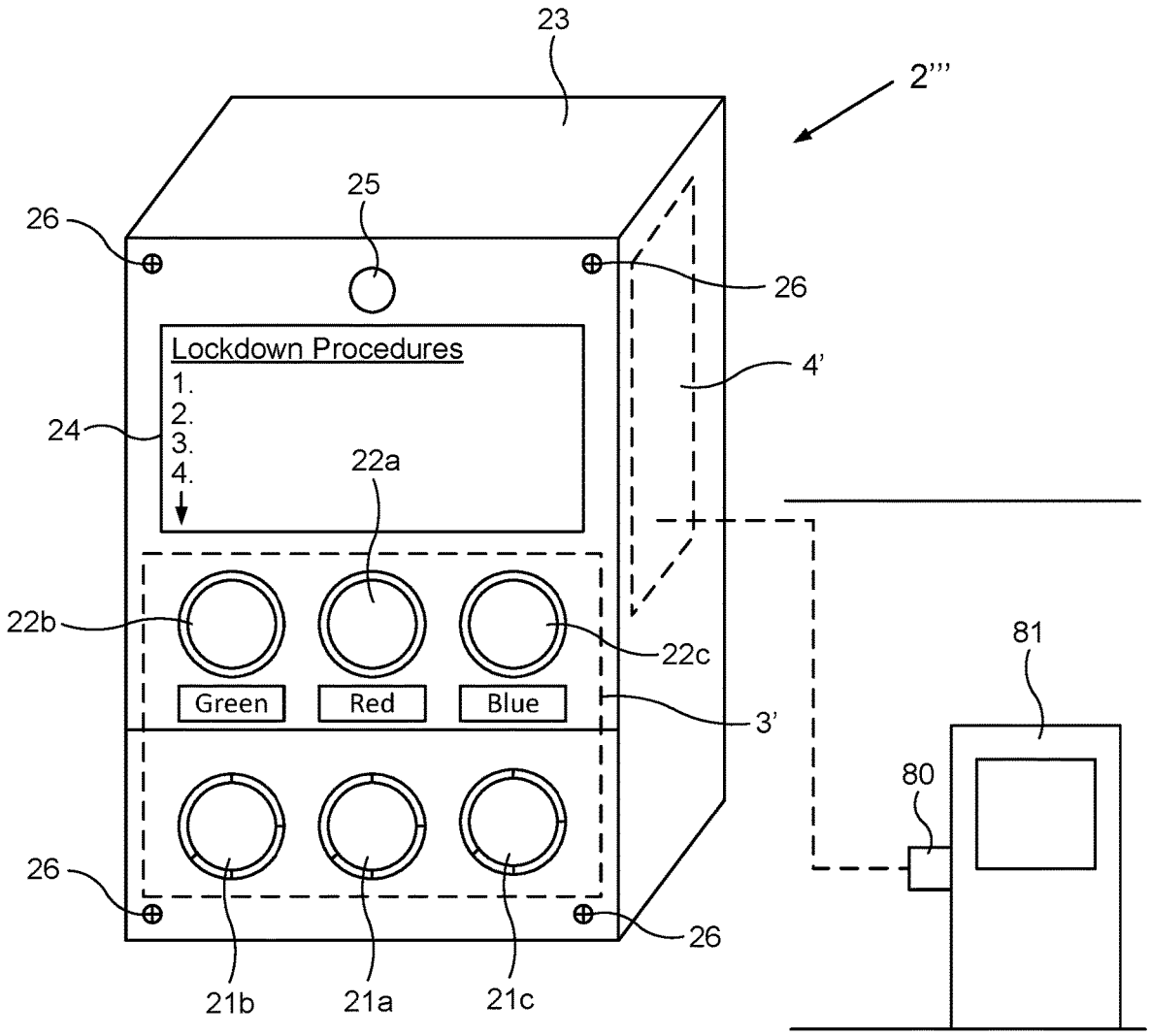
FIG. 8 is a perspective view of a further embodiment of a condition transmitter device 2''' for use in a security notification system 1.

FIG. 8 is a perspective view of a further embodiment of a condition transmitter device 2''' for use in a security notification system 1 of the present invention. FIG. 8 shows condition transmitter device 2''' in conjunction with a classroom door 81. The present embodiment corresponds to the embodiment shown in FIG. 2, with the exception of locking device 80. Locking device 80 comprises an electromagnetic door lock, and is connected with a locking trigger output of transmitter communication interface 4'. Locking device 80 can be configured to automatically lock or unlock the classroom door 81 when the user activates a safety condition, pursuant to an existing protocol set by the institution 40. This is particularly advantageous during a lockdown, since here, the teachers are typically required to lock the door 81 of the room 41 they are in under certain conditions.

FIG. 9 is a schematic view of a further embodiment of a security notification system 1" having a plurality of condition transmitter devices 2 and a corresponding plurality of condition indicator devices 5. The embodiment of FIG. 9 corresponds to the embodiment of FIG. 4, with the exception of a local hub 95 comprising an additional central condition indicator device 90. Local hub 95 may be located in the headmaster's office, the security office of the campus 40, or in the police office of the town or municipality where the campus 40 is located.

The central condition indicator device 90 in the present embodiment is a computing device having a processor unit 91, display unit 92, and a central indicator communication interface 93. The central condition indicator device 90 comprises programming to receive security notification signals from a plurality of condition transmitter devices 2 simultaneously, to decode (based upon identification information associated with each transmitter 2) which transmitters 2 are conveying the information, and to display the corresponding security conditions within the corresponding rooms 41 on display unit 92. Maps and other information shown on display 92 can be sent to compatible displays on police squad cars that are dispatched to the scene 40 of the emergency, and to police and first responder mobile devices.

According to the present embodiment, the transmitter communication interfaces 4 of the condition transmitter devices 2 are configured to provide secondary security notification signals to the central indicator communication interface 93 over a wireless connection, such as a Wi-Fi connection, or a wired connection. The secondary security notification signals provided by the transmitter communication interfaces 4 correspond to the respectively selected security conditions of the corresponding condition transmitter devices 2, and further comprise identification information, allowing correlating the received security notification signal to a specific condition transmitter device 2, and thus a specific one of the rooms 41. The identification information can include a date and time stamp on all messages and signals emanating from transmitter 2, the location of the transmitter 2, and any substantive information sent from the transmitter 2. Information collected by local hub 95 can also include still images or video transmitted by one or more of the surveillance cameras 42. All of this information can be analyzed by a human operator stationed at the local hub 95. This allows security personnel to determine the security condition of each room 41 from the security or headmaster office or remote police station 95.

Variations to the above embodiments can be understood and effected by those skilled in the art in practicing the claimed invention, from a reading of the present drawings, written disclosure, and appended claims. For example, in some embodiments:

display 24 may comprise information regarding known nefarious individuals living proximate to the campus 40;

instead of the LED indicator lights 22*a*, 22*b*, 22*c*, 31*a*, 31*b*, 31*c*, one or more display units, such as an LED, LCD or dot-matrix display, are provided to display the activated security condition;

in the embodiments of FIGS. 2, 7 and/or 8, the image acquisition device 25 is provided external to housing 23;

in the embodiments of FIGS. 2, 7 and/or 8, the image acquisition device 25 comprises a recognition module connected to a database (located at local hub 95 or central hub 99) of attributes of persons of interest, as that term has been previously defined in this specification;

in the embodiments of FIGS. 2, 7 and/or 8, the image acquisition device 25 is connected with a video recording unit such as a digital video recorder instead of, or in addition to, being connected with the Internet;

in the embodiment of FIG. 3, the condition indicator device 5' comprises, instead of piezo horn 32, a different type of acoustic notification module;

in the embodiments of FIGS. 1, 2, 4, 7 and/or 8, the transmitter communication interface 4, 4' is configured to additionally transmit a second security notification signal to a further device, such as a central condition indicator device 90, central hub 99, a computing device, or a phone operated by security personnel, by e-mail or text message; the system can be programmed to transmit the second security notification signal automatically, so that security personnel don't have to worry about sending those signals to further devices themselves;

in the embodiments of FIGS. 1, 2, 4, 7 and/or 8, the transmitter communication interface 4, 4' comprises a digital input and/or output enabling a connection to an external device, such as a motion sensor, switch, alarm relay or door lock 80;

the system 1, 1', 1" comprises a backup battery device, connected to condition transmitter device 2, 2', 2", 2'" and/or condition indicator device 5, 5', to provide said devices with operating power in case the primary source of power becomes depleted;

in the embodiments of FIGS. 5 and/or 6, the remote activation units 50, 60, instead of being connected with said condition transmitter device 2, 2', 2", 2'", are connected with the indicator communication interface 6, 6' of said condition indicator device 5, 5';

in the embodiments of FIGS. 4 and 9, multiple display units 43, such as LED indicator poles, are provided at each entrance of the campus 40 to indicate if a security condition is set, which condition is set, and whether the building 40 is safe to enter; and/or the intercom unit 70, instead of comprising a cellular module, is configured to connect to provide audio communication with a corresponding second intercom unit or computing device, over a wired or wireless connection, such as over a phone line or Internet connection.

Figure 10:
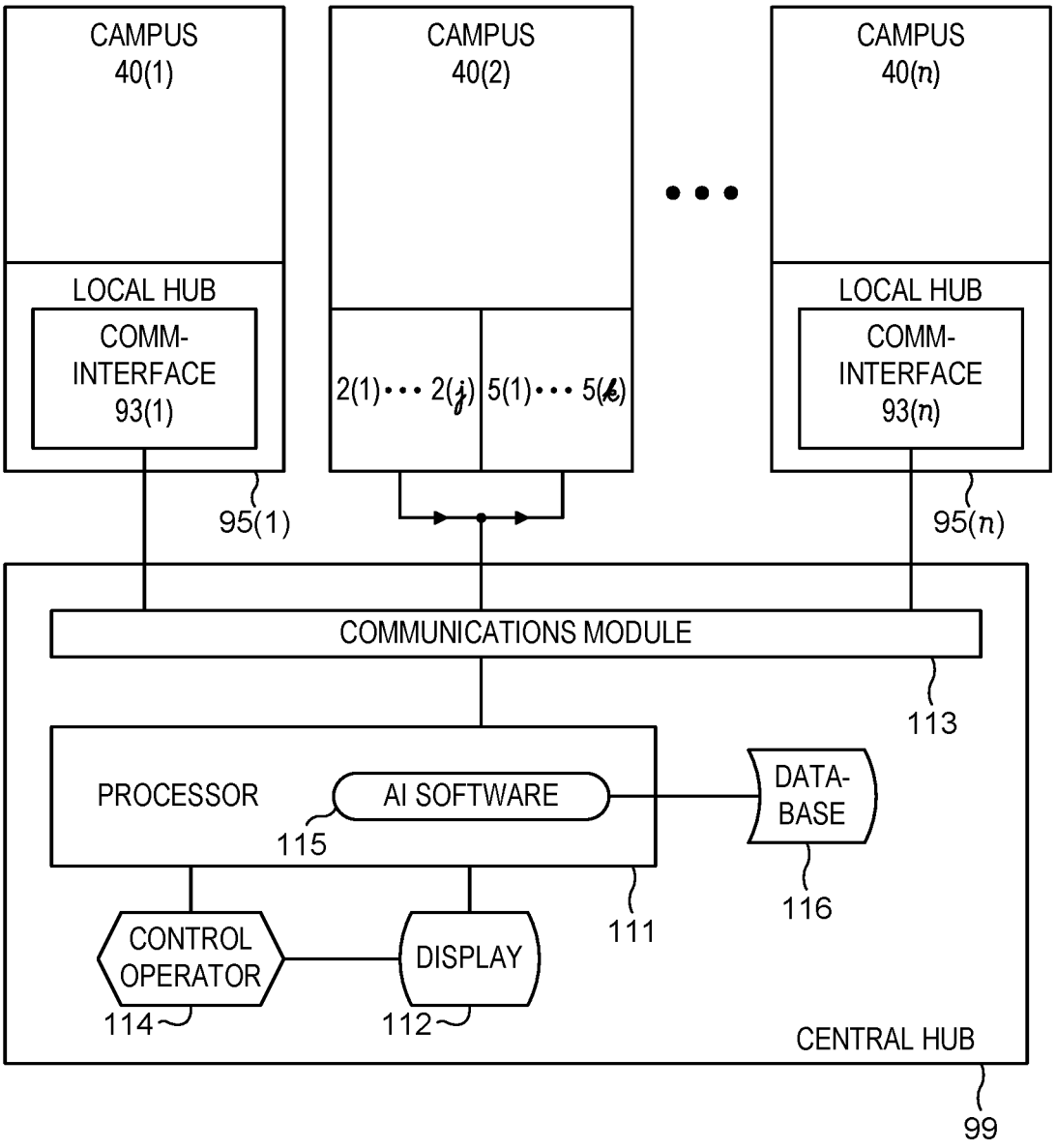
FIG. 10 is a block diagram of an embodiment of the present invention in which central hub 99 is employed.

FIG. 10 illustrates an embodiment of the present invention in which a central hub 99 is used in lieu of, or in addition to, one or more local hubs 95 associated with one or more campuses 40. FIG. 10 illustrates an integral number n of campuses 40. Some of these campuses 40 have local hubs 95, as previously described, and some of the campuses 40 do not. In the illustrated example, campuses 40(1) and 40(*n*) have associated local hubs 95, but campus 40(2) does not have a local hub 95. Central hub 99 is operated by the organizational entity that is responsible for the operation of the overall system 1, encompassing all of the campuses 40 in the system.

Central hub 99 comprises communications module 113, processor 111, and display 112, and is under the control of human operator 114. Module 113 comprises an input/output buffer, and is the interface for communications between central hub 99 and the individual campuses 40. For those campuses that have a local hub 95, communications module 113 communicates with the communications interface 93 associated with said local hub 95. For those campuses that do not have a local hub 95, communications module 113 communicates directly with the condition transmitters 2 and the condition indicators 5 associated with that campus 40. Messages coming into central hub 99 from the campuses 40 are buffered by communications module 113 and then passed to processor 111, which performs one or more processing steps upon these messages. Artificial intelligence software 115 associated with processor 111 is then invoked to determine the probability of an intruder's location and identity, based upon what is being communicated by the condition transmitters 2 to central hub 99. In making these determinations, artificial intelligence software 115 takes into account all inputs, such as time stamps affixed to the messages; substantive contents of the messages; any audio, video, and text associated with the messages; and historical threat information contained in database 116. The information stored in database 116 comprises attributes of persons of interest, as that term has been previously been defined in this specification. AI software 115 may be more sophisticated than the software associated with the local hubs 95, whereby central hub 99 plays an important role in assisting the local security personnel in evaluating threats and responding to the threats.

Coupled to processor 111 is display 112, e.g., a computer screen, which displays a map of the location where the security incident is taking place. Individual rooms 41 of the affected campus 40 can be highlighted on the map in red, green, or blue, depending respectively on whether that particular room 41 has been deemed to be subject to an active security threat (red), deemed to be safe (green), or a room (blue) where the status is uncertain, e.g., not all of the students who are normally supposed to be in that room 41 are currently accounted for. Flashing green can be used to communicate uncertainty on the map, in lieu of blue, or can be used if a third security status is not part of the protocol of the reporting campus 40.

A human control operator 114 is stationed at centnral hub 9 at all times. Operator 114 monitors the display 112 and communicates with the processor 111 by means currently available in the computer art, e.g., by mouse, keyboard, speaker, headphones, video camera, voice commands coupled to voice recognition software within processor 111, etc. Human control operator 114 reviews tentative conclusions produced by the artificial intelligence software 115 and, based upon his or her best judgment, ratifies the tentative conclusions, rejects them, or modifies them, producing an intelligence report. Operator 114 then instructs processor 111 to relay the intelligence report back to the field via communications module 113, which sends the intelligence report to the communications interface 93 of a campus 40 having a local hub 95, or, in the case of a campus 40 not having a local hub 95, to the condition indicators 5 and wearable devices 100 of the campus 40.

In those embodiments where central hub 99 is employed, messages and commands emanating from central hub 99 are normally given operational priority over messages and commands emanating from a local hub 95.

Figure 11:
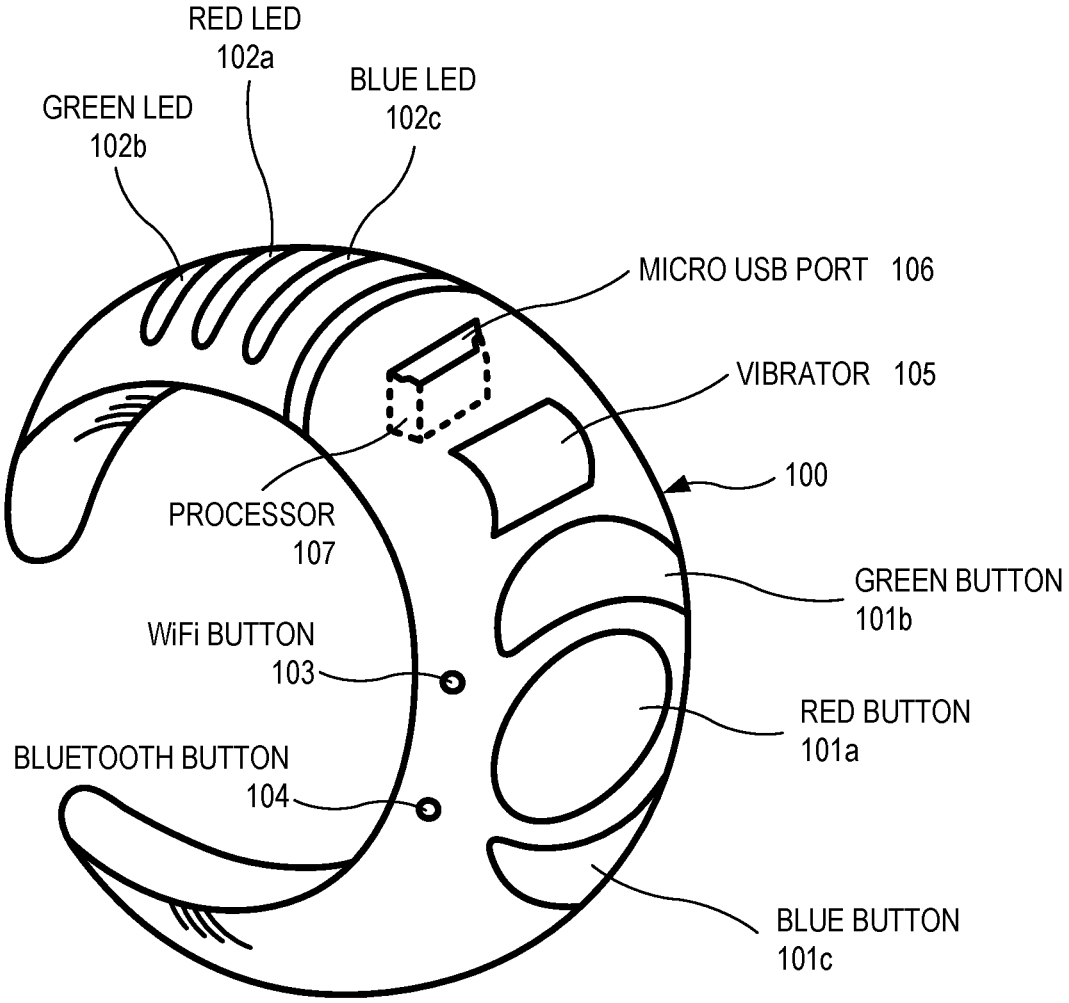
FIG. 11 is a perspective view of a wearable bracelet or ring 100 that can be used as a condition transmitter device 2 and/or a condition indicator device 5.

FIG. 11 illustrates an embodiment of a portable device 100 that can be worn by individual teachers and other authority figures involved with the school or other location 40 where the present invention is implemented. The device 100 can be embodied as a wearable bracelet or ring 100, enabling the wearer to move freely from room to room 41 within the campus 40 and still have the capability to communicate with condition indicators 5, local hubs 95, and central hub 99.

Device 100 can be constructed to operate as a condition transmitter device 2, as a device indicator device 5, or as both. Thus, some of the features of wearable device 100 disclosed herein have attributes enabling device 100 to communicate information to condition indicators 5, local hubs 95, and central hub 99; and some of the features have attributes enabling device 100 to receive information from condition transmitters 2, local hubs 95, and central hub 99.

One of the important items that is usually present on wearable device 100 is a vibrator 105. Since device 100 is a wearable device, it is assumed that device 100 makes continuous contact with the wearer's skin. Thus, transmitters 2, local hubs 95, and central hub 99 can communicate to the wearer via vibrator 105. An important aspect of the use of vibrator 105 is that these signals and other communications sent to the wearer can be communicated to the wearer without the knowledge of other individuals in the same room 41 as the wearer. For example, if a local hub 95 or a central hub 99 has reason to suspect that a security incident may be taking place on the campus 40, but hub 95, 99 is not certain of this, said information can be communicated via vibrator 105 discreetly, without alarming the other individuals in the room 41, such as students. This can be a critical component of an effective threat response.

Various types and categories of messages can be communicated to the wearer via vibrator 105, e.g., by changing the number and spacing of pulses sent via vibrator 105. For example, a single pulse can indicate suspicion of an active security incident on campus 40, three pulses in rapid succession can indicate certainty of a security condition, etc. Alternatively, messages encoded in Morse code can be sent via vibrator 105 to communicate to the wearer more informative substantive messages.

In some embodiments, vibrator 105 is set to vibrate if the wearer attempts to leave the campus 40 without leaving the wearable device 100 on the campus 40, e.g., at the security office. Each wearable device 100 can be recharged in a docking station, which can be located at the security office or other preferred location.

In some embodiments, wearable device 100 comprises a Wi-Fi button 103 and/or a Bluetooth button 104. Pressing one of these buttons 103, 104 enables the wearer to establish communications using an existing Wi-Fi network or an existing Bluetooth network, respectively.

In some embodiments, wearable device 100 comprises a set of buttons 101 which function in much the same way as buttons 21 described in conjunction with FIGS. 2, 7 and 8, and buttons 51, 52, and 58 described in conjunction with FIG. 5. There are typically three buttons 101: red alert button 101*a*, green alert button 101*b*, and blue alert button 101*c*. Pressing one of these buttons 101 enables the wearer of the device 100 to signal the current condition of the room 41 to one or more condition indicator devices 5, local hub 95, and/or central hub 99, in much the same way as a transmitter 2.

In some embodiments, wearable device 100 comprises a set of LEDs 102, much the same as LEDs 22 described in conjunction with FIGS. 2, 7, and 8, and LED 56 described in conjunction with FIG. 5. There are typically three LEDs 102: red LED 102*a*, green LED 102*b*, and blue LED 102*c*. In some embodiments, the LEDs 102 serve to memorialize the security condition that has been set by whatever button 101 has been pressed by the wearer. In other embodiments, the LEDs 102 serve to notify the wearer of a security condition that has been communicated by transmitter 2, a local hub 95, or central hub 99.

In some embodiments, wearable device 100 comprises a processor 107 to control the motor of the vibrator 105. In some embodiments, processor 107 has access to pre-stored messages that can be sent by device 100 to a condition indicator 5, a local hub 95, and/or central hub 99; these messages are automatically selected based upon which of the three buttons 101 is pressed by the wearer, and are sent via the pre-selected Wi-Fi network or Bluetooth network. In some embodiments, processor 107 contains voice recognition software which places into digital form voice messages that are enunciated by the wearer and conveyed to processor 107 via a speaker (not illustrated) embedded in wearable device 100.

In some embodiments, device 100 comprises a micro USB port 106 coupled to processor 107. Micro USB port 106 is used to recharge the electrical circuitry (batteries) associated with processor 107 as well as the other illustrated components of device 100. Micro USB port 106 can also be used to convey reprogramming instructions to processor 107, and to change or augment the executable software associated with processor 107 and/or the data to which processor 107 has access.

Figure 12:
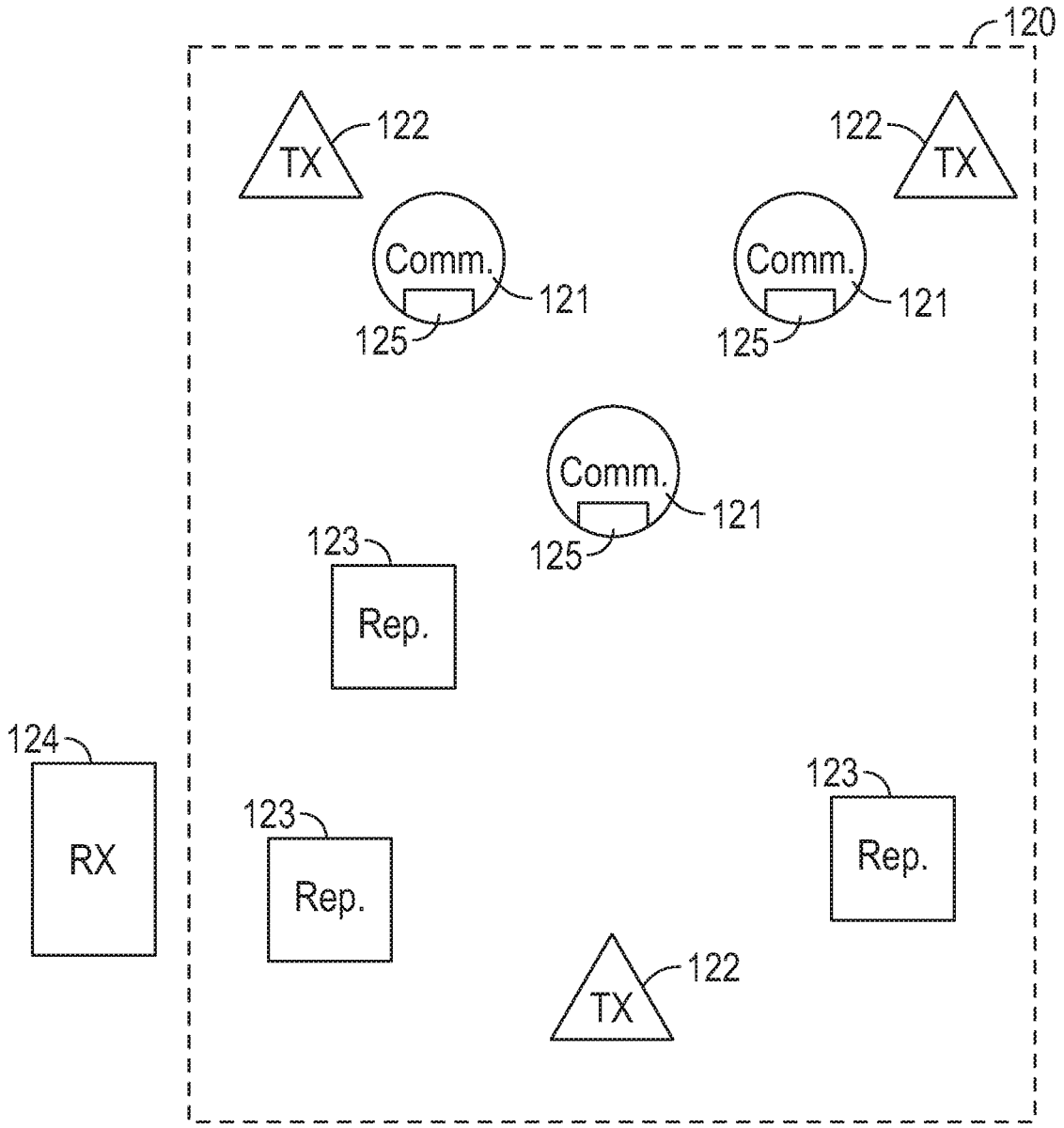
FIG. 12 is a sketch of an embodiment of the present invention in which fixed beacons 122 are used to give precise location information to a plurality of mobile communications devices 121 within a defined environment 120.

In the embodiment of the present invention illustrated in FIG. 12, a plurality of mobile communications devices 121 are distributed within a defined environment 120. The defined environment may be one or more rooms within a hospital, correctional facility, school, or any private or public building. The mobile communications devices 121 may be cellular telephones that are commonly carried on the persons of the faculty, staff, or students who inhabit the defined environment 120. Cellular telephones of the present day are often equipped with software that uses the GPS (Global Positioning System) satellite system to provide the user of the cellular phone 121 with its location. However, for some defined environments 120, such as buildings containing a lot of steel, cellular telephones may not operate normally. Even in those situations where the cellular telephone is able to communicate with its assigned cellular telephone cell tower, the GPS location information available to the cellular phone 121 is notoriously inaccurate, particularly when the phone 121 is indoors. The FIG. 12 embodiment illustrates a system and methods for allowing the cellular phones or other mobile communications devices 121 to have very precise location information. Precision is often critical in situations where the mobile communications device 121 needs to communicate with one or more receivers 124 located outside the confines of the defined environment. For example, these situations include cases where a nefarious individual or individuals penetrate the defined environment 120 with ill intent. In such cases, it is imperative that first responders, who have access to the information received by the receiver(s) 120, be given precise location information.

The FIG. 12 embodiment is a mental health, safety, and wellness support system that can be operational at all times, and provides a full circle of communications among predefined users of devices 121 and 123, counselors associated with devices 121, and security personnel, law enforcement professionals, and emergency medical technicians (collectively, "first responders") to promote mental health and wellness, and to provide a way to report episodes of mental instability, including, but not limited to, hostility, impulsivity, and aggressive outbursts that may or may not present safety risks. The defined environment 120 may be a hospital, correctional facility, school, or any other public or private building or grounds.

Reporting devices 123 may be desktop computers or mobile computerized devices, such as cellular telephones. The inputs from the devices 123 are sent to mobile communications devices 121, and may include names, ages, company, organization, and/or school affiliation of one or more persons proximate the reporting devices 123. Each room within defined environment 120 typically contains at least one transmitting beacon 122.

Reporting devices 123 have many or all of the characteristics of the mobile communications devices 121. As used herein, the difference between devices 121 and 123 is that mobile communications devices 121 are equipped to receive wireless signals from beacons 122 and from reporting devices 123, and are further equipped to send wireless signals to receiver(s) 124. On the other hand, the only requirement for reporting devices 123 is that they are equipped to send wireless signals to mobile communications devices 121, and optionally to receive wireless signals from devices 121.

In a preferred embodiment, one or more reporting devices 123 is configured to send a floor plan or map of part or all of the defined environment 120 to mobile communications devices 121. In preferred embodiments, the map or floor plan shows locations of the transmitting beacons 122, as well as locations of the cognizant mobile communications devices 121 and reporting devices 123. The mobile communications device 121, in turn, is configured to relay the floor plan or map to the at least one outside receiver 124. This can be important when the first responders associated with receiver 124 need to know the exact current floor plan of the defined environment 120, which may be critical in enabling them to respond successfully to an emergency situation.

Figure 13:
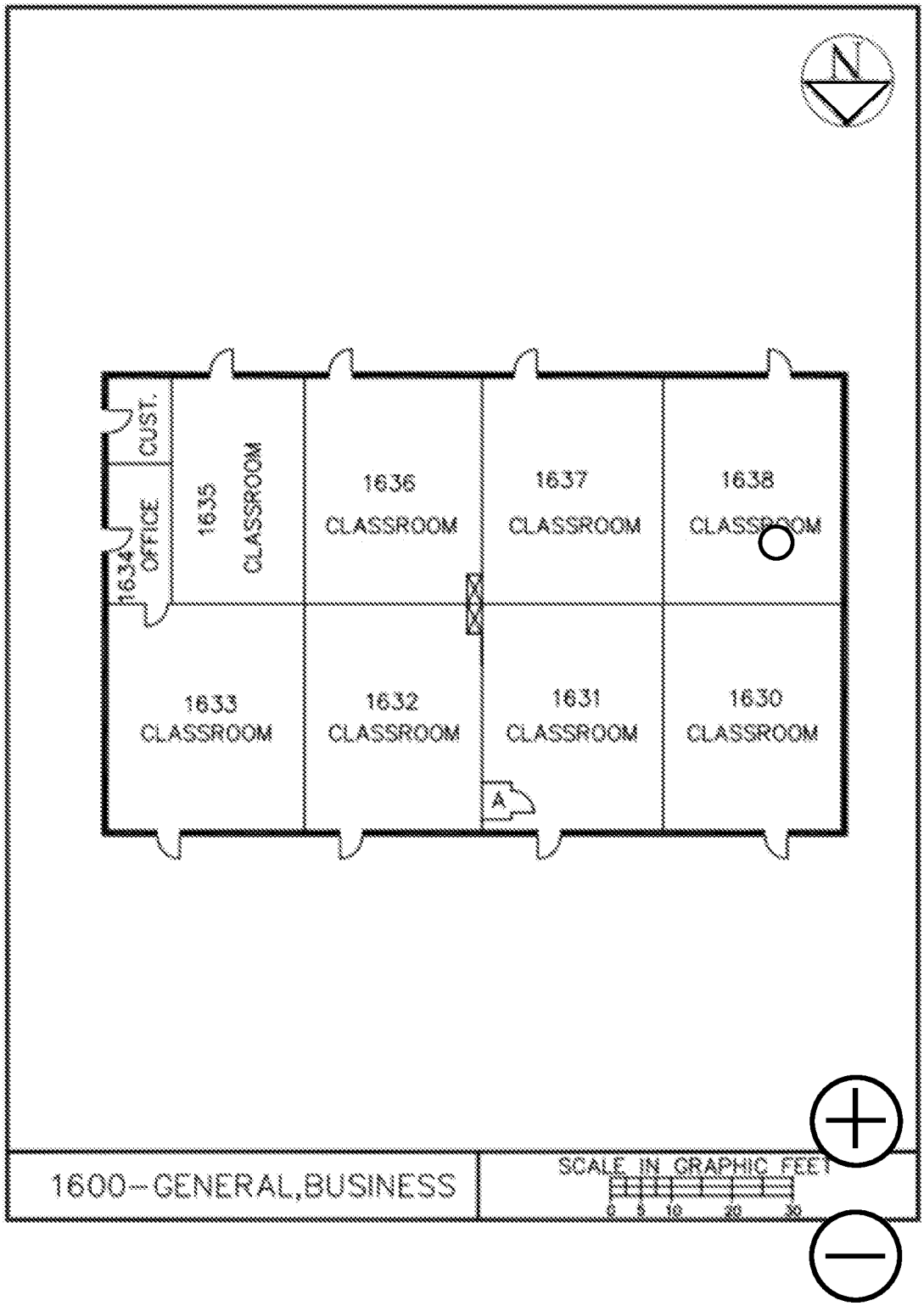
FIG. 13 is an example of a floor plan of a defined embodiment 120. This floor plan is of a type that can be sent by a reporting device 123 and/or a mobile communication device 121, as described herein.

FIG. 13 shows an example of a typical floor plan from a school embodiment of the present invention. The classrooms are clearly delineated and numbered. The dot in classroom 1638 illustrates a "red" or "assistance needed" condition. The plus and minus signs show that a zoom feature has been incorporated into the floor plan.

The embodiment described in FIG. 12 may operate in conjunction with other embodiments described herein. For example, a condition transmitter device 2 or a wearable device 100 may be incorporated within a mobile communications device 121.

Each transmitting beacon 122 is situated at a known fixed location within defined environment 120. Beacons made by Estimote are suitable for this purpose. These beacons 122 are battery operated, provide a visual indication of the amount of battery capacity remaining, and contain useful analytics as well. Such beacons 122 communicate with the mobile communications devices 121 using the Bluetooth protocol. Each mobile communications device 121 contains a processor 125, such as any suitable commercially available microprocessor. Applications software within each processor 125 is configured to process the information received from one or more beacons 122 to calculate the precise location of the mobile communications device 121. It is preferable for a device 121 to receive beacon signals from at least two beacons 122, and it is best for a device 121 to receive signals from three beacons 122 in a triangulation geometry. Signals received by a device 121 from a beacon 122 inform device 121 as to the direction from which the beacon 122 signal is emanating, and, from the strength of the transmitted signal, the distance from the beacon 122 to the device 121. By this technique, processor 125 can derive the precise location of device 121 from the locations of the beacons 122.

Each beacon 122 knows its precise location from the following. First, using x and y coordinates, a site map is plotted and recorded for each room in the defined environment 120. Second, each beacon 122 is placed at a precise known location with its assigned room, with the location of the beacon 122 noted on the site map using x and y coordinates. Next, the device 121 determines its precise location within the room from one or more proximate beacons 122 using the technique described in the above paragraph. Finally, the processor 125 within device 121 communicates to receiver 124 the specific location of device 121, again using x and y coordinates. This provides for a more accurate determination of location, and transmission of the location to the outside world, than is achievable with GPS. Any built-in GPS capability within device 121 can be used as a backup to the primary determination of location using the beacons 122.

In addition to receiving floor plan or map information from at least one reporting device 123, the reporting devices 123 can provide other relevant information to device 121, including all the types of information described herein in conjunction with FIGS. 1 through 11, such as current conditions in the vicinity of device 123, the presence or absence of any injuries, the types of weapons used by intruders, etc.

Each processor 125 can be programmed to provide one or more of the following functions:

Monitor inputs from one or more desktop or mobile reporting devices 123. The inputs can include location data for the reporting device(s) 123, messages or notifications from pre-defined users of the reporting devices 123 to counselors and/or other support personnel associated with the cognizant mobile communications device 121, etc. The inputs can include profile data such as, without limitation, names, ages, company, organization, and/or school affiliation of individuals proximate the reporting device(s) 123.

Indication of a need for assistance from a counselor or other support staff to be conveyed to personnel associated with receiver(s) 124.

One-way or two-way personalized chat messages between individuals associated with a mobile communications device 121 and a reporting device 123. These messages can use the SMS protocol in the case of text messages, or protocols customized for a particular environment 120. The text messages can include a notification that emergency communications with first responders has been made.

Voice recorded messages between devices 121 and 123.

Recorded one-way or two-way video exchanged between devices 121 and 123.

Live video feeds exchanged between devices 121 and 123.

Indication of a need for assistance from medical emergency responders.

Indication of a need for assistance from law enforcement.

Indication of a need for assistance from company, organization, or school employees.

Sharing of GPS locations of devices 121, 123 in conjunction with information obtained from proximity beacons 122. This sharing can be done continuously or for emergency purposes only.

Sharing of a floor plan or map of all or portions of the environment 120 tailored for individual users of devices 121 and 123.

Indication of a stable or unstable condition in the proximity of a reporting device 123 related to mental health, safety, and/or wellness.

Combining inputs from devices 123 with floor and property plans for the environment 120. Individual rooms or areas within the environment 120 can be designated as either stable or unstable based upon the inputs of individual users 123.

Tailored requests for assistance from first responders based upon individual indications of stable or unstable conditions associated with users of devices 123.

Selective activation of emergency alerts related to mental health, safety, and/or wellness based upon inputs from devices 123.

Monitoring the activation of emergency alerts related to mental health, safety, and/or wellness.

Promulgation of non-emergency drill alerts related to mental health, safety, and/or wellness. These drill alerts may be selectively correlated with locations of the devices 121, 123.

Inclusion of first responders in the promulgation of the non-emergency drill alerts.

Real-time status updates to be relayed to receiver(s) 124 and device(s) 123.

Access to password protected cloud-based Web portals.

Summarization of emergency or non-emergency status updates, or stable or unstable areas, designated visually on the floor plans and maps described above.

Sharing real-time video footage received from devices 123 with first responders.

Using video images to provide location information to first responders.

Displaying real-time images on the device 121 aggregating images received from other devices 121, 123.

Conveying the aggregated images described above to first responders.

Using software commands to lock and/or unlock doors within the environment 120, and sending information pertaining to such commands to first responders.

Monitoring privacy settings of devices 121, 123 upon activation of the processor 125.

Synchronizing communications received from beacons 122 and devices 123 with one or more wireless protocols used for communications between other beacons 122 and devices 123. Such protocols can include the Bluetooth, Wi-Fi, and Zigbee protocols.

Connecting with the Internet via any suitable protocol, such as analog, dial-up, DSL, cable, satellite, cellular, ISDN, B-ISDN, ADSL, ADSL+2, SDSL, VDSL, T1, Bonded T1, T3, OC3, etc.

Monitoring and deciphering text messages from devices 123, and correlating the text messages with emergency or non-emergency alerts from other users of devices 123 and/or first responders associated with receivers 124.

Enabling a user of the device 121 to annotate, record, and share information with users of other devices 121, 123.

Allowing first responders to share and augment said annotations and recordations.

Guiding or navigating personnel within environment 120 or outside first responders to locations within environment 120 where certain status reports have been emanating.

In the claims, the word "comprising" does not exclude other elements or steps, and the indefinite article "a" or "an" does not exclude a plurality. A single processor, module or other unit may fulfill the functions of several items recited in the claims.

A computer program may be stored/distributed on a suitable medium, such as an optical storage medium or a solid-state medium supplied together with or as part of other hardware, but may also be distributed in other forms, such as via the Internet or other wired or wireless telecommunication systems.

The above description is included to illustrate the operation of preferred embodiments, and is not meant to limit the scope of the invention. The scope of the invention is to be limited only by the following claims. From the above description, many variations will be apparent to one skilled in the art that would yet be encompassed by the spirit and scope of the present invention.

What is claimed is:

1. A system for providing security or mental health support within a defined environment, the system comprising:

at least one communication device further comprising:

a condition transmitter device;

a user interface; and a processor coupled to memory configured to:

receive at least one of a floor plan a map, or a property plan from the memory;

determine a precise location of the at least one communication device within at least one of the floor plan the map, or the property plan to a room level accuracy via one or more wireless protocol;

transmit an optional audio, video, or text input from the user interface associated with a pre-defined user of the at least one communication device; and transmit a security condition input associated with the pre-defined user of the at least one communication device; and a central hub communicatively coupled to the at least one communication device, the central hub comprising:

a processor coupled to memory configured to:

affix one or more time stamps to one or more of: the location of the at least one communication device; the security condition input; the optional input of audio, video, and text; or an optional signal from one or more reporting devices;

combine two or more of: the one or more time stamps; the location of the at least one communication device; the security condition input; the optional input of audio, video, and text; or the optional signal from the one or more reporting devices;

designate via the processor, a probability of an unstable condition based on: the one or more time stamp; the location; the security condition input; or the optional input of audio, video, and text;

determine a relevancy of at least one of: the location; the security condition input; the optional input of audio, video, and text; or the optional signal from the one or more reporting devices;

generate a single report containing the probability of the unstable condition and any relevant location, security condition input, or the optional input of audio, video, and text; and transmit the single report to the at least one receiver for use by a first responder to identify a precise location to successfully respond to the emergency situation with an unstable condition.

2. The system of claim 1 wherein:

the user interface does not require more than a single button for each security condition.

3. The system of claim 1 wherein:

the at least one communication device is further configured to:

receive an optional signal from the one or more reporting devices.

4. A method for providing security or mental health support within a defined environment, the system comprising:

receiving at least one of a floor plan or a property plan from a memory of at least one communication device;

determining a precise location of the at least one communication device within at least one of the floor plan or the property plan to a room level accuracy via one or more wireless protocol;

transmitting an optional audio, video, or text input from a user interface associated with a pre-defined user of the at least one communication device;

transmitting a security condition input associated with the pre-defined user of the at least one communication device;

affixing one or more time stamps to one or more of: the location of the at least one communication device; the security condition input; the optional input of audio, video, and text; or an optional signal from one or more reporting devices;

combining two or more of i) the location of the at least one communication device, ii) the security condition input, iii) the optional input of audio, video, and text, iv) the optional signal from one or more reporting devices, and v) the one or more time stamps;

designating a probability of an unstable condition based on the time stamp, the location, the security condition input, and the optional input of audio, video, and text;

determining a relevancy of at least one of the security condition input, the location, the optional signal from the one or more reporting devices, and the optional input of audio, video, and text;

generating a single report containing the probability of the unstable condition and any relevant security condition input, location input, and the optional input of audio, video, and text; and transmitting the single report to the at least one receiver for use by a first responder to identify a precise location to successfully respond to the emergency situation with an unstable condition.

5. The system of claim 1 wherein:

the at least one communication device is a cellular telephone.

6. The system of claim 1 further comprising:

one or more wireless devices, each comprising: a local beacon or a network for WiFi, Zigbee, Bluetooth, or cellular device; and wherein:

the wireless protocol used to determine a precise location of the at least one communication device comprises a connection to the one or more wireless devices.

7. The system of claim 1 wherein:

the processor and the memory are configured to:

monitor inputs from the one or more reporting devices, the inputs including at least one of a name, an age, and an affiliation of at least one person situated proximate to the one or more reporting devices.

8. The system of claim 1 further comprising:

a plurality of communication devices coupled to the central hub; and wherein:

two or more of the plurality of communications devices are configured to send at least one of a map or a floor plan to the at least one receiver.

9. The system of claim 1, wherein the central hub further comprises:

a database containing attributes of one or more persons of interest.

10. The method of claim 4 wherein:

the user interface is activated with a single pulse for an active security incident.

11. The method of claim 4 further comprising:

determining a precise location of the at least one communication device using a wireless protocol connection to one or more of: a local beacon; or a network for WiFi, Zigbee, Bluetooth, or cellular device.

12. The method of claim 11 wherein:

each local beacon determines its precise location within the defined environment by assigning x and y coordinates for the local beacon on a site map of the defined embodiment.

13. The method of claim 4 further comprising:

monitoring inputs from the one or more reporting devices, the inputs including at least one of a name, an age, and an affiliation of at least one person situated proximate to the one or more reporting devices.

14. The method of claim 4 further comprising:

sending at least one of a map, a floor plan, or a property plan to the at least one receiver from two or more of a plurality of communications devices.

15. The method of claim 4 further comprising:

determining via artificial intelligence software associated with processor, the probability of an intruder's location and identity, based upon information communicated by a condition transmitter of the at least one communication device to the central hub.

16. The method of claim 15, wherein the central hub further comprises:

the artificial intelligence software takes into account one or more inputs of time stamps affixed to the messages; substantive contents of the messages; audio, video, and text associated with the messages; and historical threat information contained in database.

17. The central hub of claim 1, wherein the central hub further comprises:

a database containing attributes of one or more persons of interest.

18. The central hub of claim 1, wherein the central hub further comprises:

monitoring inputs from the one or more reporting devices, the inputs including at least one of a name, an age, and an affiliation of at least one person situated proximate to the one or more reporting devices.

19. The central hub of claim 1, wherein the central hub further comprises:

determining via artificial intelligence software associated with processor the probability of an intruder's location and identity, based upon information communicated by a condition transmitter of the communication device to the central hub.

20. A central hub communicatively coupleable to one or more communication devices, the hub comprising:

a processor and a memory coupled together and configured to:

affix one or more time stamps to one or more of: the location of the one or more communication devices; the security condition input; the optional input of audio, video, and text; or an optional signal from one or more reporting devices;

combine two or more of: the one or more time stamps; the location of the communication device; the security condition input; the optional input of audio, video, and text; or the optional signal from the one or more reporting devices;

designate via the processor, a probability of an unstable condition based on: the one or more time stamp; the location; the security condition input; or the optional input of audio, video, and text;

determine a relevancy of at least one of: the location; the security condition input; the optional input of audio, video, and text; or the optional signal from the one or more reporting devices;

generate a single report containing the probability of the unstable condition and any relevant location, security condition input, or the optional input of audio, video, and text; and transmit the single report to the at least one receiver for use by a first responder to identify a precise location to successfully respond to the emergency situation with an unstable condition.

* * * * *